US008652719B2

(12) United States Patent
Uchinokura et al.

(10) Patent No.: US 8,652,719 B2
(45) Date of Patent: Feb. 18, 2014

(54) TONER, PROCESS CARTRIDGE, AND IMAGE FORMING APPARATUS

(75) Inventors: Osamu Uchinokura, Shizuoka (JP); Satoshi Ogawa, Nara (JP); Junichi Awamura, Shizuoka (JP); Teruki Kusahara, Shizuoka (JP); Daisuke Ito, Kanagawa (JP); Daisuke Inoue, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 3 days.

(21) Appl. No.: 13/449,779

(22) Filed: Apr. 18, 2012

(65) Prior Publication Data

US 2012/0288299 A1 Nov. 15, 2012

(30) Foreign Application Priority Data

May 9, 2011 (JP) ..... 2011-103958

(51) Int. Cl.
*G03G 9/10* (2006.01)
*G03G 9/00* (2006.01)
*G03G 13/01* (2006.01)

(52) U.S. Cl.
USPC ..... 430/107.1; 430/45.51; 430/109.4

(58) Field of Classification Search
USPC ..... 430/107.1, 109.4, 45.51
See application file for complete search history.

(56) References Cited

U.S. PATENT DOCUMENTS

| | | | | |
|---|---|---|---|---|
| 6,737,210 | B2 | 5/2004 | Uchinokura et al. | |
| 2010/0173239 | A1* | 7/2010 | Iftime et al. | 430/107.1 |
| 2010/0183966 | A1* | 7/2010 | Kadokura et al. | 430/107.1 |
| 2010/0183967 | A1* | 7/2010 | Sabu et al. | 430/107.1 |
| 2011/0262856 | A1 | 10/2011 | Sugimoto et al. | |
| 2012/0052431 | A1 | 3/2012 | Hozumi et al. | |
| 2012/0052434 | A1 | 3/2012 | Sugimoto et al. | |
| 2012/0064447 | A1 | 3/2012 | Hozumi et al. | |

FOREIGN PATENT DOCUMENTS

| | | |
|---|---|---|
| EP | 1 336 903 A2 | 8/2003 |
| EP | 2 009 504 A1 | 12/2008 |
| EP | 2 110 710 A1 | 10/2009 |
| JP | 4-70765 | 3/1992 |
| JP | 4-181264 | 6/1992 |
| JP | 4-352175 | 12/1992 |
| JP | 6-148935 | 5/1994 |
| JP | 7-271135 | 10/1995 |
| JP | 8-44110 | 2/1996 |
| JP | 8-278662 | 10/1996 |
| JP | 8-334920 | 12/1996 |
| JP | 10-161347 | 6/1998 |

(Continued)

OTHER PUBLICATIONS

Extended European Search Report Issued Aug. 28, 2012 in Patent Application No. 12165100.4.

*Primary Examiner* — Stewart Fraser
(74) *Attorney, Agent, or Firm* — Oblon, Spivak, McClelland, Maier & Neustadt, L.L.P.

(57) ABSTRACT

A set of toners including yellow, cyan, magenta, and black toner, each of which containing a binder resin containing a crystalline resin and a non-crystalline resin, a releasing agent, and a corresponding coloring agent, wherein the following relationship is satisfied: 0.8<EBk/EFc<0.95, where EBk represents the amount of heat of melting (mJ/mg) for the black toner and EFc represents the average amount of heat of melting (mJ/mg) of the yellow toner, magenta toner, and cyan toner from 50° C. to 100° C. at the first temperature rising in differential scanning calorimetry (DSC).

12 Claims, 3 Drawing Sheets

(56) References Cited

FOREIGN PATENT DOCUMENTS

| | | |
|---|---|---|
| JP | 10-268562 | 10/1998 |
| JP | 2000-321815 | 11/2000 |
| JP | 2001-117277 | 4/2001 |
| JP | 2004-245854 | 9/2004 |
| JP | 2004-246345 | 9/2004 |
| JP | 2006-208609 | 8/2006 |
| JP | 2006-337872 | 12/2006 |
| JP | 2009-109971 | 5/2009 |

* cited by examiner

TONER, PROCESS CARTRIDGE, AND IMAGE FORMING APPARATUS

CROSS-REFERENCE TO RELATED APPLICATION

This patent application is based on and claims priority pursuant to 35 U.S.C. §119 to Japanese Patent Application No. 2011-103958, filed on May 9, 2011, the entire disclosure of which is hereby incorporated by reference herein.

BACKGROUND OF THE INVENTION

1. Field of the Invention

The present invention relates to a set of toners, a set of development agents, a process cartridge, and an image forming apparatus.

2. Description of the Background Art

In electrophotography, electrostatic recording, electrostatic printing, etc., latent electrostatic images are formed on an image bearing member (photoreceptor, photoconductor); the latent electrostatic image is developed with a development agent containing toner to obtain a visible image (toner image); and the visible image is transferred to a recording medium followed by fixing to obtain a fixed image.

Development agents are classified into a single component development agent formed of magnetic toner or non-magnetic toner and a two component development agent formed of toner and a carrier.

With regard to fixing, a heat roller system in which a heating roller is directly pressed against the toner image on the recording medium is widely used. However, the heat roller system requires a large amount of electric power for fixing.

To save energy, various approaches have been studied including a sleep mode to reduce the consumption power of the heating roller. For example, the power output of the heater for heating roller is reduced while images are not produced and increased while images are output to raise the temperature of the heating roller.

However, users are obliged to wait for some several tens of seconds for the system to return from the sleep mode before the heating roller is ready again for fixing. In addition, it is desirable to completely power off the heater to cut the power consumption.

To meet these demands, it is necessary to reduce the fixing temperature of the toner itself, and lower the fixing temperature of the toner while it is actually used.

With regard to the toner for use in a development agent, with advances in electrophotographic technology, toner having excellent low-temperature fixing ability and preservability (blocking resistance) has come to be sought. Accordingly, polyester resins have been tried because these exhibit superior low-temperature fixing ability and a higher affinity with recording media than do polystyrene resins, which typically have been used as binder resins for toner.

For example, Japanese Patent Application Publication No. JP-2004-245854-A describes an approach using toner containing a linear polyester resin stipulating specific physical properties such as molecular weight. JP-H4-70765-A describes an approach using toner containing a non-linear cross-linking type polyester resin using rosins as the acid component.

Binder resins available in the market are still inadequate to satisfy current demand with regard to the performance speed of an image forming apparatus and the reduction of the energy consumption thereof. It is extremely difficult to maintain the fixing strength if the fixing time is set to be shorter in the fixing process and the heating temperature of the fixing device is set to be low.

Toner containing polyester resins using rosins as described in JP-H4-70765-A mentioned above have excellent low-temperature fixing ability and an advantage that toner productivity by the pulverization method is improved because the toner has excellent pulverization property. Furthermore, by using 1,2-propane diol, which is a branch-type alcohol having three carbon atoms as the alcohol component, low-temperature fixing ability is improved without degrading offset resistance compared to an alcohol having one or two carbon atoms, and deterioration of preservability due to a drop in glass transition temperature is avoided when compared with a branch-type alcohol having four or more carbon atoms. Using such a polyester resin as the binder resin for toner makes it possible to conduct fixing at a low temperature and improve preservability.

However, although low-temperature fixing ability continues to improve by using a polyester having excellent low-temperature fixing ability, it is difficult in the near future to satisfy ever-greater demand for energy efficiency simply by using polyester resin alone.

JP-2006-208609-A describes introducing a fixing helping component into the toner to improve low-temperature fixing ability, thereby creating toner having a good combination of high-temperature preservation property and low-temperature fixing ability by making the fixing helping component present in the toner as crystal domains. JP-2009-109971-A and JP2006-337872-A describe using toner having a good combination of high-temperature preservation property and low-temperature fixing ability by introducing a crystalline polyester resin into the toner. However, as apparatus performance improves, toner is required to satisfy demand for both high durability and further energy efficiency simultaneously, which is difficult to do.

On the other hand, with regard to the releasing agent, JP-H8-278662-A, JP-H8-334920-A, JP-H10-161347-A, and JP-2000-321815-A describe manufacturing toner having excellent low-temperature fixing ability, hot offset resistance, and blocking resistance by adding releasing agents to the toner. However, particularly when these toners are used in a high-speed image forming apparatus, the combination of hot offset resistance and low-temperature fixing ability of the toners is not so good, and even when they have good low-temperature offset resistance and low-temperature fixing ability at the same time, the toners are slightly inferior in blocking resistance, resulting in deterioration of development property or an inability to maintain good offset resistance at both low temperatures and high temperatures.

JP-2004-246345-A describes an image forming apparatus providing excellent preservability for an extended period of time by controlling the dispersion of the releasing agent to ameliorate blocking resistance in addition to improving offset resistance and fixing ability.

However, when images having a high image area ratio are processed in the image forming apparatus employing this system for a long run length, a minute amount of the wax (releasing agent) contained in the toner to release the toner during fixing remains on the fixing member when releasing the toner. This inevitably happens to obtain the releasing property while preventing occurrence of offset. However, since this minute amount of wax remaining on the fixing member is in a high-temperature state, the wax volatilizes, attaches to, and accumulates on or around the fixing device. Thereafter, the attached and accumulated wax flows in a block due to radiation heat and causes production of defective images on which oil is attached.

JP-H08-44110-A describes a toner having a volatile component in an amount of less than 0.1% by weight and a wax component having a maximum peak in a temperature range of from 70° C. to 130° C. along the differential scanning calorimetry (DSC) curve during a temperature rise, with the maximum heat generation peak during a temperature descent in the range of around +9° C. to −9° C. relative to the maximum peak temperature. This toner has improved fixing ability and hot offset resistance so that the obtained toner has no adverse impact on the photoreceptor and the development agent bearing member.

However, the phenomenon that isolated wax volatilizes and accumulates in the fixing portion, resulting in contamination in the image forming apparatus, stems from the volatility of the wax itself. Therefore, although successful in some degree, the cause of the contamination still remains, so that production of abnormal images on which oil is attached is not completely prevented even if the content of the volatile component in the toner is regulated and reduced.

In addition, with regard to color printers and photocopiers employing electrophotography which have come to be widely used in recent years, although reproduction of full color images thereby is relatively good, the full color machines are slow in forming monochrome images relative to printers and photocopiers dedicated to produce monochrome images. In addition, monochrome images produced by the full color machines are glossy relative to those produced by the monochrome machines. Therefore, the full color machines need improving in some cases.

In particular, since low gloss (matte) monochrome images are popular, glossy monochrome images produced by such color image forming apparatuses are not selected due to their gloss. Therefore, with regard to black toner, the same resin as contained in the black toner for use in dedicated machines and/or a resin having a relatively high softening point are used for the color machines to reduce the gloss.

For example, JP-H6-148935-A describes a method of controlling the gloss by regulating the molecular weight distribution and the melting viscosity of the resin component of black toner and changing the amount of heat applied when fixing monochrome images and when fixing color images. However, even when the properties of the black toner are regulated, the gloss of color toners and the black toner may become noticeable in color reproduction. In such a case, photo images containing black portions such as human faces look visually undesirable due to the gloss difference. In particular, color images containing both letters and photos have a large gloss difference between the highlight portion and the letter portions, resulting in production of visually undesirable images.

In addition, even when the color and black portions have similar gloss in color reproduction, the development amounts for color photo images are different with regard to color photo images, for example, less with the pale color portion but more with the black portion in particular. In such a color image, gloss tends to be not uniform over the image, resulting in production of a visually undesirable image in which the black portion is extremely glossy.

To solve this problem, JP-H10-268562-A describes an approach of regulating the gloss difference between color toner portions and black toner portions in color images. However, the black toner still remains glossy when producing monochrome images. Therefore, it is difficult for color machines producing monochrome images using this approach to gain acceptance.

SUMMARY OF THE INVENTION

In view of the foregoing, the present invention provides a set of toners including yellow, cyan, magenta, and black, toner, each of which contains a binder resin containing a crystalline resin and a non-crystalline resin, a releasing agent, and a corresponding coloring agent, wherein the following relationship is satisfied: $0.8<EBk/EFc<0.95$, where EBk represents the amount of heat of melting (mJ/mg) for the black toner and EFc represents the average amount of heat of melting (mJ/mg) of the yellow toner, magenta toner, and cyan toner from 50° C. to 100° C. at the first temperature rising in differential scanning calorimetry (DSC).

As another aspect of the present invention, a set of development agents that contains a carrier and the set of toners mentioned above.

As another aspect of the present invention, a process cartridge detachably attachable to an image forming apparatus having an image bearing member, and a development device that uses the set of toners mentioned above to develop images formed on the image bearing member.

As another aspect of the present invention, an image forming apparatus having an image bearing member to bear a latent electrostatic image, a charger to charge the surface of the image bearing member, an irradiator to irradiate the surface of the image bearing member with light to form the latent electrostatic image thereon, a development device to supply the set of toners mentioned above in a development agent to the latent electrostatic image formed on the surface of the image bearing member to obtain a visual image, a transfer device to transfer the visual image on the surface of the image bearing member directly or by way of an intermediate transfer body to a recording medium, and a cleaner to remove the toner remaining on the surface of the image bearing member after the visual image is transferred to the recording medium.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE PRESENT DISCLOSURE

Next, embodiments of the present disclosure are described with reference to accompanying drawings.

The set of toners of the present disclosure for use in electrophotography employing the YMCK (yellow, magenta, cyan, and black) system, each of the toners contains a binder resin component containing at least a crystalline resin and a non-crystalline resin, a releasing agent, and a corresponding coloring agent (yellow, magenta, cyan, or black) and satisfies the following relationship: 0.8<ratio of heat of melting (EBk/

EFc)<0.95, where EBk represents the amount of heat of melting [mJ/mg] used for black toner and EFc [mJ/mg] (average of the three colors), for the color toners, from 50° C. to 100° C. in the first temperature rising in the differential scanning calorimetry (DSC) method. Both the crystalline resin and the non-crystalline resin are preferably polyester resins.

Furthermore, gloss is required for the yellow toner, the magenta toner, the cyan toner, and other color toners used for a particular purpose and it is preferable that gloss for the black toner is low in comparison with that for the color toners.

The present inventors have found based on experimental results that there is a relationship between the amount of heat of melting in the range of from 50° C. to 100° C. and the gloss so that the gloss of an image can be controlled by adjusting the amount of heat of melting of the toner.

In addition, in this adjustment, the amount of heat of melting for black is slightly reduced relative to the other colors. As described above, overlapping black is relatively rare in a full color image so that the attached amount of black is relatively small, thereby having almost no adverse impact on the low temperature fixing ability.

A ratio (EBk/EFc) of the amount of heat of melting that is excessively small tends to result in a negative impact on the low temperature fixing ability of the black toner. By contrast, a ratio (EBk/EFc) of the amount of heat of melting that is too large tends to produce images with no gloss difference between the black portion and the color portions so that no significance is provided and images a users desires is not obtained. Although the gloss difference between the black and the colors is not uniformly determined, that the gloss of the black is about from 50% to 90% of that of the colors is thought to be good.

The toner of the present disclosure is described with reference to the accompanying drawings. This toner is used in an image forming apparatus 1 described below.

Figure 1:
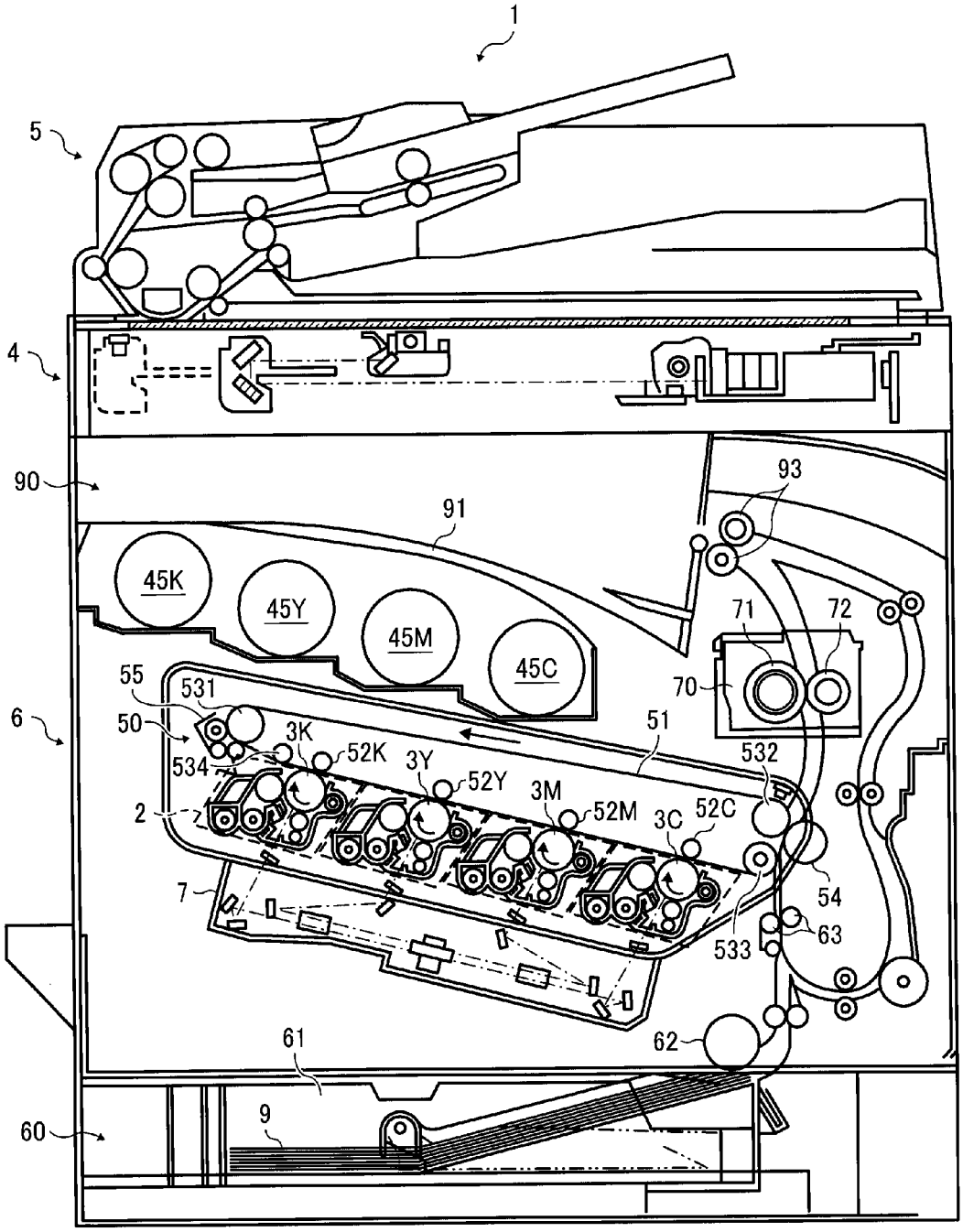
FIG. 1 is a schematic diagram illustrating the structure of the inside of a tandem type image forming apparatus, which is one of the embodiments of the image forming apparatus using the toner according to the present disclosure.

FIG. 1 is a schematic diagram illustrating the structure of the inside of a tandem type image forming apparatus, which is one of the embodiments of the image forming apparatus using the toner according to the present disclosure.

Figure 2:
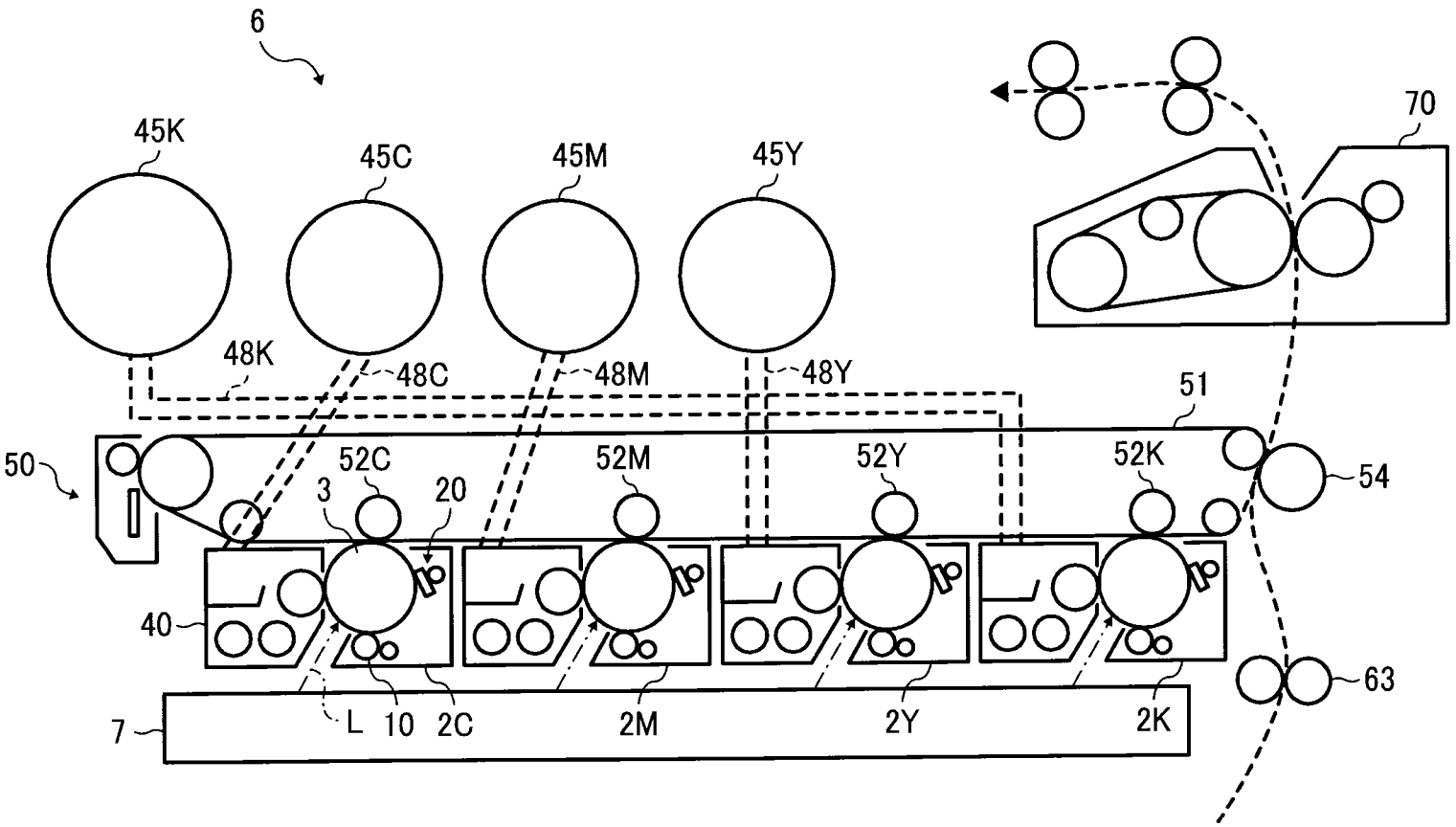
FIG. 2 is a schematic diagram illustrating the structure of the main part of the image forming unit of one embodiment of the image forming apparatus using the toner according to the present disclosure.

FIG. 2 is a schematic diagram illustrating the structure of the main part of the image forming unit of one embodiment of the image forming apparatus using the toner according to the present disclosure.

The image forming apparatus 1 according to the present disclosure includes an automatic document feeder (ADF) 5 to automatically convey a document (original) placed thereon, an image reader 4 to read the original, an image forming unit 6 to form toner images, and a sheet feeder 70, which are arranged from top to bottom in FIG. 1.

In addition, a discharger 90 on which a recording medium 9 is placed after the toner image is formed on the recording medium 9 is arranged between the image reader 4 and the image forming unit 6.

The image forming unit 6 is arranged in the center of the image forming apparatus 1. The image forming unit 6 employs a tandem system in which four process cartridges 2 serving as image forming units are arranged in parallel almost in the center of the image forming unit 6 and one of black (K) toner, yellow (Y) toner, magenta (M) toner, and cyan (C) toner is contained in each of the four process cartridges 2. The arrangement of the four process cartridges 2 corresponding to the four color toners is different between in FIG. 1 and FIG. 2 and can be changed depending on desired image quality. In addition, the image forming unit 6 includes an intermediate transfer belt 51 having an endless form including a substrate adjusted to have a moderate resistance. The intermediate transfer belt 51 is formed of heat resistance materials such as polyimides and polyamides and is rotatably driven while suspended over four supporting rollers 531, 532, 533, and 534. The symbol "50" in FIG. 1 represents a transfer device (unit).

Referring to FIG. 1 and FIG. 2, an irradiator 7 is located below the four process cartridges and irradiates the surface of each of charged image bearing members 3 (3Y, 3M, 3C, 3K) based on image data of each color to form latent electrostatic images thereon. Primary transfer rollers 52 (52Y, 52M, 52C, 52K) are arranged facing the image bearing members 3 (3Y, 3M, 3C, 3K), respectively, with the intermediate transfer belt 51 therebetween and primarily transfer the toner images formed on the image bearing members 3 to the intermediate transfer belt 51. The primary transfer rollers 52 are connected to a power source and predetermined voltages are applied the primary transfer rollers 52.

A secondary transfer roller 54 is pressed against the intermediate transfer belt 51 from the outside thereof at the portion supported from the inside by the supporting roller 532. The secondary transfer roller 54 is connected to a power source and predetermined voltages are applied to the secondary transfer rollers 54. The contact portion of the secondary transfer roller 54 and the intermediate transfer belt 51 is a secondary transfer portion where the toner image on the intermediate transfer belt 51 is transferred to the recording medium 9.

An intermediate transfer belt cleaner 55 that cleans the surface of the intermediate transfer belt 51 after the secondary transfer is provided to the outside of the portion of the intermediate transfer belt 51 supported by the supporting roller 531.

A fixing device 70 that fixes the toner image on the recording medium 9 semi-permanently is provided above the secondary transfer portion. The fixing device 70 is formed of a fixing roller 71 and a pressing roller 72 pressed against the fixing roller 71, which has a halogen heater inside. In addition, a combination of a heating roller having a halogen heater inside thereof and a fixing belt having an endless form which is wound around the heating roller is also suitably used instead of the fixing roller 71.

A sheet feeder 60 that accommodates the recording medium 9 and feeds it toward the secondary transfer portion is provided below the image forming unit.

Respective devices are described in detail below.

Figure 3:
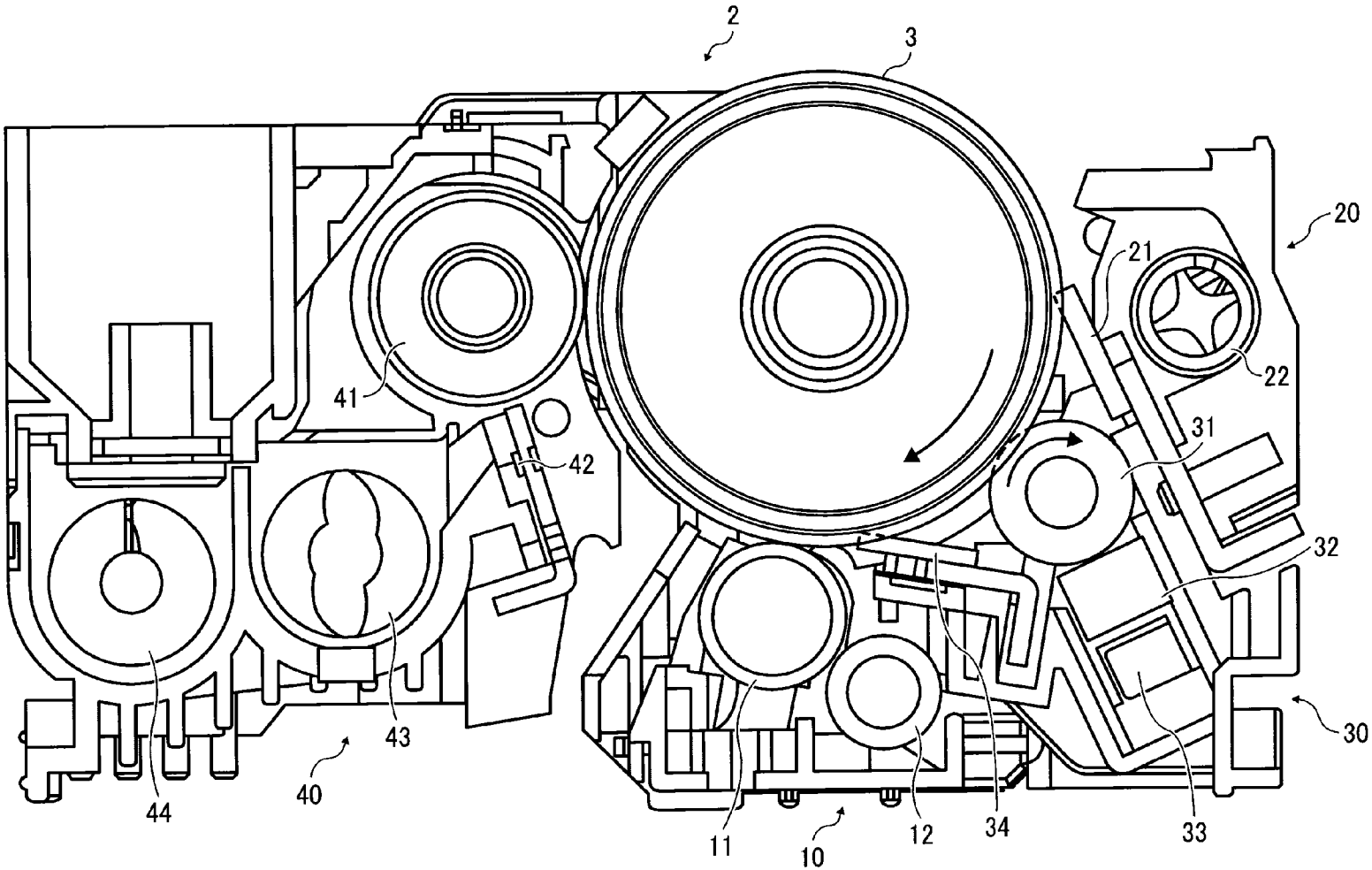
FIG. 3 is an enlarged diagram illustrating the structure of one of the four process cartridges.

In FIG. 3, the image bearing member 3 is formed of amorphous silicon, metal such as selenium, or organic materials. In the following, the organic photoconductors are described below. The (organic latent electrostatic) image bearing member 3 includes an electroconductive substrate on which a resin layer in which fillers are dispersed, a photosensitive layer having a charge generation layer and a charge transport layer, and a protective layer on which fillers are dispersed are sequentially laminated.

The photosensitive layer employs a single-layered structure containing a charge generating material and a charge transport material and a laminate structure having a charge generation layer and a charge transport layer. The latter is better in terms of the sensitivity and the durability.

The charge generation layer can be formed by dispersing a pigment having a charge generating power and an optional binder resin in a suitable solvent using a ball mill, an attritor, a sand mill, a bead mill, or an ultrasonic and applying the liquid dispersion to the electroconductive substrate followed by drying. Specific examples of such binder resins include, but are not limited to, polyamides, polyurethanes, epoxy resins, polyketones, polycarbonates, silicone resins, acrylic resins, polyvinyl butyrals, polyvinyl formals, polyvinyl ketones, polystyrenes, polysulfones, poly-N-vinyl carbazoles, polyacrylamides, polyvinyl benzals, polyesters, phenoxy resins, copolymers of vinylchloride-vinyl acetates, polyvinyl acetates, polyphenylene oxides, polyvinyl pyridines, cellulose-based resins, caseine, polyvinyl alcohols, and polyvinyl pyrrolidones. The content of the binder resin is from 0 to 500 parts by weight and preferably from 10 parts by weight to 300 parts by weight based on 100 parts by weight of the charge generation material.

The charge transport layer can be formed by dissolving or dispersing these charge transport materials and the binder resins in a suitable solvent followed by coating and drying. The charge transport materials includes hole transfer materials and electron transport materials. Specific examples of the binder resins for the charge transport layer include, but are not limited to, thermoplastic resins or thermosetting resins, such as a polystyrene, a styrene-acrylonitrile copolymer, a copolymer of styrene—butadiene copolymer, a copolymer of styrene—maleic anhydride, a polyester, a polyvinyl chloride, a copolymer of vinyl chloride—vinyl acetate, a polyvinyl acetate, a polyvinylidene chloride, a polyarylate (PAR) resin, a phenoxy resin, a polycarbonate, a cellulose acetate resin, an ethyl cellulose resin, a polyvinyl butyral, a polyvinyl formal, a polyvinyl toluene, a poly-N-vinyl carbazole, an acrylic resin, a silicone resin, an epoxy resin, a melamine resin, an urethane resin, a phenol resin, and an alkyd resin.

A protective layer is optionally provided on the photosensitive layer. By forming a protective layer to improve the durability, the (latent electrostatic) image bearing member 3 having a high sensitivity without defectives can be more suitably used.

Specific examples of the materials for use in the protection layer include, but are not limited to, ABS resins, ACS resins, copolymers of olefin—vinyl monomer, chlorinated polyether, aryl resins, phenolic resins, polyacetal, polyamide, polyamideimide, polyacrylate, polyarylsulfone, polybutylene, polybutylene terephthalate, polycarbonate, polyarylate, polyethersulfone, polyethylene, polyethylene terephthalate, polyimide, acrylic resins, polymethylpentene, polypropylene, polyvinylidene chloride, and epoxy resins. Among these, polycarbonate and polyarylate are most suitably used. Fluorine resins such as polytetrafluoroethylene, silicone resins, or a mixture in which inorganic fillers such as titanium oxide, tin oxide, potassium titanate, and silica and/or organic fillers are dispersed in these resins can be added to improve the abrasion resistance. Although the concentration of the filler in the protective layer varies depending on the kind of the filler and the electrophotography process conditions under which the (latent electrostatic) image bearing member 3 is used, the ratio of the filler to the total amount of the solid portion on the outermost side of the protective layer is about 5% by weight or more, preferably from about 10% by weight to about 50% by weight, and more preferably from about 10% by weight to about 30% by weight.

A charger 10 includes a charging roller 11 serving as a charging member formed of an electroconductive metal core covered by an elastic layer having a moderate resistance. The developing roller 11 is connected to a power source and a predetermined voltage is applied to the charging roller 11. The charging roller 11 is arranged in the vicinity of the image bearing member 3 with a minute gap therebetween. This minute gap is set by, for example, winding a spacing member having a predetermined thickness around the non-image forming areas situated at both ends of the charging roller 11 to contact the surface of the spacing members with the surface of the image bearing member 3. In addition, the charging roller 11 can be provided in the vicinity of the image bearing member 3 without a contact. The charging roller 11 charges the image bearing member 3 by discharging at the portion in the vicinity thereof. In addition, it is possible to reduce contamination by residual toner on the charging roller 11 because the charging roller 11 does not contact the image bearing member 3. In addition, the charging roller 11 has a charging cleaning roller 12 that cleans the surface of the charging roller 11 by contact.

In a development device 40, a development roller 41 that has a magnet generating a magnetic field in the inside is provided at the position facing the image bearing member 3. Below the development roller 41, two supplying and stirring screws 43 and 44 are provided that have a mechanism of pumping up toner supplied from a toner bottle to the development roller 41 while mixing and stirring the toner with a development agent. A two component development agent containing toner and magnetic carriers conveyed by the development roller 41 is regulated by a regulator 42 to have a predetermined thickness and borne on the development roller 41. The development roller 41 bears and conveys the development agent to supply the toner to the latent image surface of the image bearing member 3 at the position where the development roller 41 faces the image bearing member 3 while moving in the same direction as the image bearing member 3. The development agent on the development roller 41 is separated by a development agent separating board, collected in the development device 40, stirred and charged together with replenished toner again, and returned to the development process.

Moreover, toner cartridges 45 (45Y, 45C, 45M, 45K) of each color that accommodate unused respective color toners are detachably attached to the space above image bearing member 3.

As illustrated in FIG. 2, the toner is supplied to each development device 40 through a toner supplying route 48 (48Y, 48M, 48C, 48K) by a toner conveying device such as a Moineau pump and an air pump. The toner cartridge 45K may particularly have a large capacity because black toner is consumed more than the other color toners.

A cleaner 20 has a mechanism in which a cleaning blade 21 contacts and detaches from the image bearing member 3 by the controller of the image forming apparatus. The cleaning blade 21 contacts the image bearing member 3 in an encountering manner to remove residual toner remaining on the image bearing member 3 and additives such as talc, china clay, and calcium carbonate of the recording medium attached as contaminants.

The removed toner is transferred by a waste toner collecting coil 22 and accommodated in a waste toner container.

A lubricant applicator 30 includes a solid lubricant 32 accommodated in a fixed case, a brush roller 31 that contacts and scrapes the solid lubricant 32 and applies the lubricant to the image bearing member 3, and a lubricant application blade 34 to regulate the lubricant applied by the brush roller 31.

The solid lubricant 32 is formed to have a cuboid form and biased to the brush roller 31 by a pressing roller 33. Although the solid lubricant 32 is scraped by the brush roller 31 and consumed, thereby decreasing the thickness of the solid lubricant 32 over time, the solid lubricant 32 is constantly in contact with the brush roller 31 because it is pressed by the pressing roller 33. The brush roller 31 applies the lubricant scraped by rotation of the brush roller 31 to the surface of the image bearing member 3.

In this embodiment, the lubricant application blade 34 serving as the lubricant regulator is brought into contact with the surface of the image bearing member 3 downstream from the position where the lubricant is applied by the brush roller 31 relative to the moving direction of the image bearing member 3. The lubricant application blade 34 is formed of an elastic material, i.e., rubber, also has a feature of a cleaner, and is in contact with the image bearing member 3 in an encounter manner.

FIG. 3 is a schematic enlarged diagram illustrating the structure of one of the four process cartridges. Since any of configurations of the process cartridges 2 is the same to each other, the symbols of Y, M, C, and K to distinguish the colors are omitted in FIG. 3. Each of the process cartridges 2 has the image bearing member 3K, 3Y, 3M, or 3C. Around each image bearing member 3, there are provided the charger 10 that provides charges to the surface of the image bearing member 3, the development device 40 that develops a latent image formed on the surface of the image bearing member 3 with each color toner to obtain a toner image, the lubricant applicator 30 that applies the solid lubricant 32 to the surface of the image bearing member 3, and the cleaner 20 that cleans the surface of the image bearing member 3 after the toner image is transferred.

The charger 10 has the charging roller 11, a charging roller pressing spring, and the charge cleaner roller 12. The lubricant applicator 30 has the solid lubricant 32, the lubricant pressing roller 33, the brush roller 31 that applies the lubricant, and the lubricant application blade 34 that regulates the lubricant. The development device 40 has the development roller 41 that conveys the two-component development agent to the image bearing member 3, the regulator 42 that regulates the amount of the development agent on the development roller 41, the supplying and stirring screws 43 and 44 that supply the supplied toner to the development roller 41 while stirring with carriers, and the development agent separating board that separates the development agent on the development roller 41. The cleaner 20 is formed of the cleaning blade 21 and the waste toner collecting coil 22.

Although the process cartridge 2 illustrated in FIG. 3 has such a configuration, there is no specific limit to that of the process cartridge 2 as long as the process cartridge 2 has the image bearing member 3 integrally supported with at least one of the charger 10, the development device 40, the cleaner 20, and a lubricant applicator and is detachably attachable to the image forming apparatus 1.

As illustrated in FIGS. 1 and 3, the image forming apparatus 1 conducts an image forming process (charging process, irradiation process, development process, transfer process, cleaning process) to form a desired toner image on the image bearing member 3.

The image bearing member 3 is rotatably driven by a driving force. The surface of the image bearing member 3 is charged at the charger 10 (charging process).

Thereafter, the surface of the image bearing member 3 reaches the irradiation point of a laser beam L emitted by an irradiation unit, where a latent electrostatic image is formed by scanning of the beam laser L (irradiation process).

The surface of the image bearing member 3 reaches the position facing the development device 40, where the latent electrostatic image is developed to obtain a desired toner image (development process).

Thereafter, the surface of the image bearing member 3 reaches the position facing the intermediate transfer belt 51 and the primary transfer rollers 52, where the toner image on the image bearing member 3 is transferred to the intermediate transfer belt 51 (primary transfer process). A minute amount of toner which has not been transferred remains on the image bearing member 3.

Thereafter, the surface of the image bearing member 3 reaches the position facing the cleaner 20, where the residual toner remaining on the image bearing member 3 is collected by the cleaning blade 21 (cleaning process).

Finally, the surface of the image bearing member 3 reaches the position facing a discharging unit, where the residual voltage on the image bearing member 3 is removed.

These are series of the image forming process conducted on the image bearing member 3.

The image forming process is described specifically with reference to FIG. 1 to FIG. 3.

An irradiator 7 provided below the image forming unit 6 emits the laser beam L according to obtained image information to the image bearing members 3Y, 3M, 3C, and 3K of the process cartridges 2Y, 2M, 2C, and 2K, respectively.

The irradiator 7 irradiates the image bearing member 3 with the laser beam L emitted from the light source via multiple optical elements while scanning the laser beam L by a polygon mirror which is rotatably driven. Thereafter, the toner images of the respective colors formed on the respective image bearing members 3 in the development process are transferred to and overlapped on the intermediate transfer belt 51. In this way, the color image is formed on the intermediate transfer belt 51.

Four primary transfer bias rollers 52K, 52Y, 52M, and 52C form primary transfer nips by pinching the intermediate transfer belt 51 with the image bearing members 3Y, 3M, 3C, and 3K, respectively. A transfer bias having a polarity reverse to that of the toner is applied to the primary transfer bias rollers 52K, 52 Y, 52M, and 52C.

The intermediate transfer belt 51 sequentially passes through the primary transfer nips of the primary transfer bias rollers 52K, 52 Y, 52M, and 52C. Each color toner image on the image bearing members 3Y, 3M, 3C, and 3K is primarily transferred to and overlapped on the intermediate transfer belt 51.

Thereafter, the intermediate transfer belt 51 on which each color toner image is overlapped reaches the position facing the secondary transfer roller 54. At this position, the supporting roller 532 of the intermediate transfer belt 51 serving as a secondary transfer backup roller forms a secondary transfer nip by pinching the intermediate transfer belt 51 together with the secondary transfer roller 54. The color toner image formed on the intermediate transfer belt 51 is transferred to the recording medium 9 such as a transfer sheet which has been conveyed to the position of the secondary transfer nip. Toner that has not been transferred to the recording medium 9 remains on the intermediate transfer belt 51.

The toner remaining on the intermediate transfer belt 51 is removed by the cleaner 20 so that the intermediate transfer belt 51 is back to the initial state.

The series of the transfer process conducted on the intermediate transfer belt 51 complete this way.

The recording medium 9 conveyed to the position of the secondary transfer nip is conveyed from a sheet feeder cassette 61 in the sheet feeder 60 arranged on the bottom of the image forming apparatus 1 by way of a sheet feeding roller 62 and a pair of registration rollers 63.

A plurality of the recording media 9 such as transfer sheets is stacked in the sheet feeder 60. When the sheet feeding roller 62 is rotatably driven, the recording medium 9 placed on top is fed to the pair of registration rollers 63.

The recording medium 9 conveyed to the pair of registration rollers 63 is suspended at the position of the roller nip of the pair of registration rollers 63 which is not rotating but stands. To the timing of the color image on the intermediate transfer belt 51, the pair of registration rollers 63 is rotatably driven to convey the recording medium 9 to the secondary transfer nip. In this way, the desired color image is transferred to the recording medium 9.

The recording medium 9 to which the color image is transferred at the position of the secondary transfer nip is conveyed to the fixing device 70.

The fixing device 70 provided above the secondary transfer nip fixes the color image transferred to the surface of the recording medium 9 by applying heat and pressure thereto by the fixing roller 71 and the pressing roller 72.

Thereafter, the recording medium 9 is discharged outside the image forming apparatus 1 by way of a pair of sheet discharging rollers 93.

The recording medium 9 discharged outside the image forming apparatus 1 by the pair of sheet discharging rollers 93 is stacked on a discharging unit 91 as the output image.

In this way the series of the image forming process in the image forming apparatus are conducted.

The image forming apparatus 1 uses the two component development agent containing magnetic carriers and toner. The development agent is classified into a magnetic/non-magnetic single component development agent and a two component development agent. The two component development agent is widely used because controlling the amount of transfer of the toner to the development roller 41 and the amount of charge of the toner is easier.

The content of the carrier in the two-component development agent is preferably from 90% by weight to 98% by weight and more preferably from 93% by weight to 97% by weight.

There is no specific limit to the selection of the carrier. Carriers are preferable which include a core material and a resin layer that covers the core material. The core preferably has a volume average particle diameter of from 10 μm to 150 μm and more preferably from 20 μm to 80 μm. Specific examples of the materials for the resin layer include, but are not limited to, amino resins, polyvinyl resins, polystyrene resins, fluoroterpolymers such as terpolymers of tetrafluoroethylene, vinylidene fluoride, and a fluorine-free monomer, and silicone resin. These can be used alone or in combination. The resin layer optionally contains electroconductive powder. The resin layer that covers the core preferably has a thickness of from 0.1 μm to 4 μm and more preferably from 0.5 μm to 2 μm.

The toner contains a toner binder resin such as a styrene acrylic resin and a polyester resin and a coloring agent with optional materials such as a charge control agent and wax. These materials are dissolved in organic solvents to disperse the coloring agent and dissolve or disperse the releasing agent (wax), and form minute droplets by the toner manufacturing method described above followed by drying and solidification to obtain desired toner particles. The toner preferably has a volume average particle diameter of from 4 to 10 μm and more preferably from 5 to 8 μm. To improve the fluidity, etc. of the toner, external additives such as inorganic particulates and organic particulates can be also contained. Furthermore, the toner of the present disclosure can be used as the magnetic or non-magnetic single component in which no carrier is contained.

The toner of the present disclosure is described in detail below. First the materials for use in forming the toner are described.

As described above, the toner of the present disclosure for use in electrophotography employing YMCK (yellow, magenta, cyan, and black) system contains a binder resin component containing at least crystalline resins (preferably polyester resins) and non-crystalline polyester resins (preferably polyester resins), a releasing agent, and coloring agents and satisfies the following relationship: 0.8<ratio of heat of melting (EBk/EFc)<0.95, where EBk represents the amount of heat of melting [mJ/mg] used for black toner and, EFc [mJ/mg] (average of the three colors), for the color toners, from 50° C. to 100° C. in the first temperature rising in the differential scanning calorimetry (DSC) method.

Furthermore, gloss is required for the yellow toner, the magenta toner, the cyan toner, and other color toners used for a particular purpose and it is preferable that the gloss for the black toner is low in comparison with that for the color toners. The present inventors have found based on experimental results that there is a relationship between the amount of heat of melting in the range of from 50° C. to 100° C. and the gloss so that the gloss of an image can be controlled by adjusting the amount of heat of melting of the toner.

Organic Solvent

It is preferable to select organic solvents that dissolve a crystalline (polyester) resin completely at high temperatures to form a uniform solution and phase-separate from the crystalline (polyester) resin when cooled down to low temperatures to form a non-uniform solution.

To be specific, using the melting point (Tm) of the crystalline (polyester) resin as the reference, the organic solvent is suitable when it indicates the characteristics of non-solvent at (Tm−40)° C. or lower and good solvent at temperatures equal to or higher than (Tm−40)° C.

Specific examples of the organic solvents include, but are not limited to, toluene, ethyl acetate, butyl acetate, methylethyl ketone, and methylisobutyl keton. These can be used alone or in combination.

Crystalline Polyester Resin

Specific examples of the alcohol components of the crystalline polyester resins include, but are not limited to, saturated aliphatic diol compounds, particularly, 1,4-butanediol, 1,6-hexane diol, 1,8-octane diol, 1,10-decane diol, 1,12-dodecane diol, and derivatives thereof. Specific examples of the acid components of the crystalline polyester resins include, but are not limited to, dicarboxylic acids having 2 to 12 carbon atoms having a double bond (C═C) or saturated dicarboxylic acids having 2 to 12 carbon atoms, in particular, fumaric acid, 1,4-butanedioic acid, 1,6-hexanedionic acid, 1,8-octanedionic acid, 1,10-decanedionic acid, 1,12-dodecanedionic acid, and derivatives thereof. It is preferable to use crystalline polyesters synthesized from these alcohol components and acid components. Among these, in terms of reducing the difference between the endotherm peak temperature and the endotherm shoulder temperature, the organic solvent formed of one of the alcohol components of 1,4-butanediol, 1,6-hexane diol, 1,8-octane diol, 1,10-decane diol, and 1,12-dodecane diol and one of the dicarboxylic acid components of fumaric acid, 1,4-butanedioic acid, 1,6-hexanedionic acid, 1,8-octanedionic acid, 1,10-decanedionic acid, and 1,12-dodecanedionic acid.

In addition, to control the crystalline property and the softening point of the crystalline polyester resin, designing and using a non-linear polyester prepared by condensation polymerization by adding a tri- or higher alcohol such as glycerine to the alcohol component and tri- or higher carboxylic acid such as trimellitic anhydride to the acid component when synthesizing the polyester.

In addition, the structure of the molecule of the crystalline polyester resin can be confirmed by X ray diffraction, GC/MS, LC/MS, and IR measuring in addition to NMR measuring of a solution and a solid. As a simple example, in the infrared absorption spectrum, a structure having absorption peaks observed in the range of from 955 to 975 cm-1 or from 980 to 1,000 cm-1 observed based on δCH (out-of-plane bending vibration) of olefin is suitable.

With regard to the melting point Mp of the crystalline polyester ranges from 55° C. to 80° C. When the melting point is too low, the high temperature preservation property tends to deteriorate to an unreliable level. When the melting point is too high, the toner tends to fail to satisfy a target low temperature fixing ability. Therefore, it is suitable to use a crystalline polyester having a melting point of from 55° C. to 80° C. Furthermore, the melting point of the crystalline polyester is preferably from 60° C. to 75° C. This is to demonstrate the low temperature fixing ability.

With regard to the molecular weight, a crystalline polyester having a sharp molecular weight distribution and a small molecular weight has an excellent low temperature fixing ability but the high temperature preservation property thereof tends to deteriorate as the ratio of the low molecular component increases. According to the intensive study made by the present inventors from this point of view, it is found that preferably the peak position of the molecular weight distribution chart with an X axis of log(M) and a Y axis of % by weight is in the range of from 3.5 to 4.0, the half value of the peak value is 1.5 or lower, the weight average molecular weight (Mw) ranges from 3,000 to 30,000, the number average molecular weight (Mn) ranges from 1,000 to 10,000, and the molecular weight distribution (Mw/Mn) ranges from 1 to 10 by the measuring of the molecular weight of the soluble portion in o-dichlorobenzene by GPC. More preferably, the weight average molecular weight (Mw) ranges from 5,000 to 15,000, the number average molecular weight (Mn) is from 2,000 to 10,000, and the molecular weight distribution (Mw/Mn) is from 1 to 5.

In light of the affinity between a sheet (typically paper) and the resin, the acid value of the crystalline polyester resin is 5 mgKOH/g or greater and preferably 10 mgKOH/g or greater to obtain the desired low temperature fixing ability but at the same time preferably 45 mgKOH/g or less to improve the hot offset resistance. Furthermore, the hydroxy value of the crystalline polymer is from 0 mgKOH/g to 50 mgKOH/g and preferably from 5 mgKOH/g to 50 mgKOH/g to obtain the desired low temperature fixing ability and good charging property.

The content of the crystalline polyester in a full color toner is preferably from 3% to 25% and more preferably from 5% to 15%. When the content is too small, the low temperature fixing ability tends to deteriorate. When the content is too large, the preservability tends to deteriorate.

The binder resin component preferably contains a binder resin precursor.

In addition, the toner is preferably manufactured by dissolving/dispersing at least a coloring agent, a releasing agent, a crystalline (polyester) resin, a binder resin precursor formed of a modified (polyester) resin, and other binder resin components in an organic solvent to obtain an oil phase, dissolving a compound that elongates or cross-links with the binder resin precursor in the oil phase, dispersing the oil phase in an aqueous medium in which a particulate dispersant is present to obtain an emulsified liquid dispersion, conducting cross-linking reaction and/or elongation reaction of the binder resin precursor in the emulsified liquid dispersion, and removing the organic solvent therefrom.

Binder Resin Precursor

As the binder resin precursor, a binder resin precursor formed of a modified polyester resin is preferable. For example, isocyanate-modified and epoxy-modified polyester prepolymers are preferable. This and a compound (amines) having an active hydrogen group conduct elongation reaction, thereby improving the releasing width (the difference between the allowable lowest fixing temperature and hot offset occurring temperature).

This polyester prepolymer can be easily synthesized by reacting a base polyester resin with a known isocyanating agent or an epoxificating agent.

Specific examples of the isocyanating agents include, but are not limited to, aliphatic polyisocyanates (e.g., tetramethylene diisocyanate, hexamethylene diisocyanate, and 2,6-diisocyanate methylcaproate); alicyclic polyisocyanates (e.g., isophorone diisocyanate and cyclohexylmethane diisocyanate); aromatic diisosycantes (e.g., tolylene diisocyanate and diphenylmethane diisocyanate); aromatic aliphatic diisocyanates (e.g., α,α,α',α'-tetramethyl xylylene diisocyanate); isocyanurates; blocked polyisocyanates in which the polyisocyanates mentioned above are blocked with phenol derivatives thereof, oximes or caprolactams; etc. These compounds can be used alone or in combination. A specific example of the epoxificating agent is epichlorohydrin.

The equivalent ratio (i.e., [NCO]/[OH]) of the isocyante group (NCO) to the hydroxy group [OH] of a base polyester is from 5/1 to 1/1, preferably from 4/1 to 1.2/1, and more preferably from 2.5/1 to 1.5/1. When the [NCO]/[OH] ratio is too large, the low temperature fixability of the toner tends to deteriorate. When the molar ratio of [NCO] is too small, the urea content in this polyester prepolymer tends to be small, which leads to deterioration of the hot offset resistance.

The content ratio of the isocyanating agent in the polyester prepolymer is from 0.5% by weight to 40% by weight, preferably from 1% by weight to 30% by weight, and more preferably from 2% by weight to 20% by weight. A content ratio that is excessively small tends to degrade the hot offset resistance and be disadvantageous in terms of having a good combination of the high temperature preservation property and the low temperature fixing ability.

In contrast, when the content is too high, the low temperature fixability of the toner tends to deteriorate.

The average number of isocyanate groups contained in a single polyester prepolymer molecule is normally not less than 1, preferably from 1.5 to 3, and more preferably from 1.8 to 2.5. When the number of isocyanate groups is too small, the molecular weight of urea-modified polyester after the elongation reaction tends to be small and thus the hot offset resistance easily deteriorates.

The binder resin precursor preferably has a weight average molecular weight of from $1\times10^4$ to $3\times10^5$.

Compound that Elongates or Cross-Links with Binder Resin Precursor

The compound that elongates or cross-links with the binder resin precursor is, for example, a compound having an active hydrogen group, typically amines. Specific examples of the amines include, but are not limited to, diamines, polyamines having three or more amino groups, amino alcohols, amino mercaptans, amino acids, and blocked amines in which the amino groups mentioned above are blocked. Specific examples of the diamines include, but are not limited to, aromatic diamines (e.g., phenylene diamine, diethyltoluene diamine, and 4,4'-diaminodiphenyl methane); alicyclic diamines (e.g., 4,4'-diamino-3,3'-dimethyldicyclohexyl methane, diaminecyclohexane, and isophoron diamine); and aliphatic diamines (e.g., ethylene diamine, tetramethylene diamine, and hexamethylene diamine). Specific examples of the polyamines having three or more amino groups include, but are not limited to, diethylene triamine and triethylene tetra amine. Specific examples of the amino alcohols include, but are not limited to, ethanol amine and hydroxyethyl aniline.

Specific examples of the amino mercaptan include, but are not limited to, aminoethyl mercaptan and aminopropyl mercaptan.

Specific examples of the amino acid compounds include, but are not limited to, amino propionate and aminocaproic acid.

Specific examples of the blocked amines include, but are not limited to, ketimine compounds which are prepared by reacting one of the amines mentioned above with a ketone such as acetone, methyl ethyl ketone, and methyl isobutyl ketone) and oxazoline compounds. Among these, diamine compounds and a mixture of diamine compounds with a small amount of polyamine compound are preferred.

Coloring Agent

Suitable coloring agents (coloring material) for use in the toner of the present invention include known dyes and pigments. Specific examples of the coloring agents include, but are not limited to, carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet Lithol Rubine GX, Permanent Red FSR, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials can be used alone or in combination. The content of the coloring agent is from 1% by weight to 15% by weight and preferably from 3% by weight to 10% by weight based on the toner.

Master batch pigments, which are prepared by combining a coloring agent with a resin, can be used as the coloring agent of the toner composition of the present disclosure. Specific examples of the binder resins for use in the master batch pigments or for use in combination with master batch pigments include, but are not limited to, the modified polyester resins and the unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins can be used alone or in combination.

The master batch for use in the toner of the present invention is typically prepared by mixing and kneading a resin and a coloring agent upon application of high shear stress thereto. In this case, an organic solvent can be used to boost the interaction of the coloring agent with the resin. In addition, flushing methods in which an aqueous paste including a coloring agent is mixed with a resin solution of an organic solvent to transfer the coloring agent to the resin solution and then the aqueous liquid and organic solvent are separated to be removed can be preferably used because the resultant wet cake of the coloring agent can be used as it is. In this case, a high shear dispersion device such as a three-roll mill, etc. can be preferably used for kneading the mixture.

Releasing Agent

The melting point of the releasing agent is preferably from 50° C. to 120° C. When the melting point is too low, the high temperature preservation property tends to deteriorate to an unallowable level. When the melting point is too high, the toner tends to fail to satisfy a target low temperature fixing ability at the fixing temperature. The melting point of the releasing agent of from 60° C. to 80° C. is more preferable because a better releasing property is demonstrated at the target fixing temperatures.

Since such waxes effectively work as the releasing agent at the interface between the fixing roller and the toner, the hot offset resistance is improved without applying the releasing agent such as oil to the fixing roller.

The melting point of the wax is obtained by measuring the maximum endotherm peak of the wax by using a differential scanning calorimeter (TG-DSC system TAS-100, manufactured by Rigaku Corporation)

For example, the following materials can be used as the releasing agent.

Specific examples of the waxes include, but are not limited to, vegetable waxes such as carnauba wax, cotton wax, Japan wax, and rice wax; animal waxes such as bee wax and lanolin; mineral waxes such as ozokelite and Cercine; and petroleum waxes such as paraffin, microcrystalline, and petrolatum.

In addition, as the releasing agents other than these natural waxes, synthesis hydrocarbon waxes such as Fischer-Tropsch wax, polyethylene wax and synthesis waxes such as esters, ketones and ethers are included.

Furthermore, aliphatic acid amides such as 1,2-hydroxy stearic amide, stearic amide, anhydrides of phthalic imide, and chlorinated hydrocarbon; and crystalline polymers having a long chain alkyl group in a branch chain such as homopolymers or copolymers (e.g., copolymer of acrylic acid n-stearyl-ethyl methacrylate) of polyacrylate such as of polymethacrylate n-stearyl, polymethacrylate n-lauryl can be also used as the releasing agents.

Charge Control Agent

The toner of the present disclosure optionally contains a charge control agent. Specific examples of the charge control agent include, but are not limited to, known charge control agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, metal salts of salicylic acid derivatives, etc.

Specific examples of the marketed products of the charge control agents include, but are not limited to, BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge control agent is determined depending on the kind of the binder resin, whether or not an additive is optionally added, and the toner manufacturing method (including the dispersion method), and thus is not unambiguously defined. However, the content of the charge control agent is preferably from 0.1 parts to 10 parts and more preferably from 0.2 parts to 5 parts by weight, based on 100 parts by weight of the binder resin. When the content is too large, the toner tends to have an excessively large amount of charge, which reduces the effect of the main charge control agent. Therefore, the electrostatic attraction force between the developing roller and the toner increases, resulting in deterioration of the fluidity of the toner and a decrease in the image density. These charge control agents can be melted and dispersed after being melted and kneaded with the master batch and the resin, directly added to an organic solvent before dispersion and dissolution, or fixed on the surface of formed toner particles.

Non-Crystalline Polyester Resin

In the present disclosure, non-crystalline unmodified polyester resins are used as the binder resin component. It is preferable that at least part of modified polyester resins obtained by conducting cross-linking and/or elongation reaction of the binder resin precursor formed of modified polyester resins and part of unmodified polyester resin are compatible.

Due to this, the low temperature fixing ability and the hot offset resistance are improved. Therefore, it is preferable that polyol and polycarboxylic acid of the modified polyester resins and the unmodified polyester resins have similar structures. In addition, the non-crystalline polyester resins for use in the liquid dispersion of the crystalline polyester can be used as the unmodified polyester resin if the non-crystalline polyester resins are non-modified.

The endotherm shoulder temperature of the unmodified polyester resin is preferably from 45° C. to lower than 65° C. and more preferably from 45° C. to lower than 55° C. When the endotherm shoulder temperature is too low, the high temperature preservation property of the toner may be easily degraded. When the endotherm shoulder temperature is too high, the low temperature fixing ability of the toner may be easily degraded.

The acid value of the unmodified polyester is from 1 mgKOH/g to 50 mgKOH/g and preferably 5 mgKOH/g to 30 mgKOH/g. Therefore, since the acid value is equal to or greater than 1 KOHmg/g, the toner tends to be negatively charged. Furthermore, the affinity between the toner and the sheet (paper) is improved, thereby improving the low temperature fixing ability. However, when the acid value is too high, the charging stability, in particular, the charging stability to the environmental change, tends to deteriorate. In the present disclosure, the unmodified polyester resin preferably has an acid value of from 1 KOHmg/g to 50 KOHmg/g.

The hydroxyl value of the unmodified polyester is 5 KOHmg/g or higher.

The hydroxyl value is measured according to the method described in JIS K0070-1966. To be specific, precisely weigh 0.5 g of a sample in measuring flask and add 5 ml of an acetylating reagent thereto. After heating the system in a hot bath at a range of from 95° C. to 105° C. for one to two hours, take out the flask from the hot bath to cool it down. Furthermore, add water to the flask followed by shaking to decompose acetic anhydride. To decompose acetic anhydride completely, heat the flask in the hot bath again for ten minutes or longer. Subsequent to cooling down, the wall of the flask is sufficiently washed out with an organic solvent.

Furthermore, measure the hydroxyl value of the resultant at 23° C. using an automatic potentiometric titrator (DL-53 Titrator, manufactured by Mettler Toledo International Inc.) and an electrode (DG113-SC, manufactured by Mettler Toledo International Inc.) and analyze the result with analysis software (LabX Light Version 1.00. 000).

A solvent mixture of 120 ml of toluene and 30 ml of ethanol is used to calibrate the device.

The measuring conditions are as follows:

Stir
Speed [%]: 25
Time [s]: 15
EQP titration
Titrant/Sensor
Titrant: CH3ONa
Concentration [mol/L]: 0.1
Sensor: DG 115
Unit of measurement: mV
Pre-dispensing to volume
Volume [mL]: 1.0
Wait time [s]: 0
Titrant addition: Dynamic
dE (set) [mV]: 8.0
dV (max) [mL]: 0.03
dV (max) [mL]: 0.5
Measure mode: Equilibrium controlled
dE [mV]: 0.5
dt [s]: 1.0
t (min) [s]: 2.0
t(max) [s]: 20.0
Recognition
Threshold: 100.0
Steepest jump
only No
Range: No
Tendency: None
Termination
at maximum volume [mL]: 10.0
at potential No
at slope No
after number
EQPs: Yes
n=1
comb. termination
Conditions: No
Evaluation
Procedure: Standard
Potential1: No
Potential2: No
Stop for reevaluation: No The urea-modified polyester resin can be used in combination with unmodified polyester resins and also polyesters modified by linking (e.g., urethane linking) other than urea linking.

When the toner composition contains a modified polyester resin such as a urea-modified polyester resin, the modified polyester resin can be manufactured by a one-shot method, etc.

As an example, the manufacturing method of the urea-modified polyester resin is described below.

First, heat polyol and polycarboxylic acid under the presence of a catalyst such as tetrabuthoxy titanate and dibutyltin oxide to 150° C. to 280° C. and optionally remove water produced with a reduced pressure to obtain a polyester having a hydroxyl group. In addition, the polyester prepolymer having an isocyanate group is obtained by reacting a polyester resin having a hydroxyl group with a polyisocyanate in a temperature range of from 40° C. to 140° C. Furthermore, react a polyester prepolymer having an isocyanate group and an amine at a temperature range of from 0° C. to 140° C. to obtain a urea-modified polyester resin.

The number average molecular weight of the urea-modified polyester resin ranges from 1,000 to 10,000 and preferably from 1,500 to 6,000.

When a polyester resin having a hydroxy group is reacted with a polyisocyanate and a polyester prepolymer having an isocyanate group with an amine, a solvent can be used if desired.

Specific examples of such solvents include, but are not limited to, inert compounds to an isocyanate group such as aromatic solvents (e.g., toluene and xylene); ketones (e.g., acetone, methylethyl ketone, and methylisobutyl ketone); esters (e.g., ethyl acetate); amides (e.g., dimethyl formamide and dimethyl acetamide); and ethers (e.g., tetrahydrofuran).

When an unmodified polyester resin is used in combination, a compound manufactured in the same manner as in the polyester resin having a hydroxyl group is mixed with a solution obtained after the reaction of the urea-modified polyester resin.

As the binder resin contained in the oil phase, the crystalline (polyester) resin, the non-crystalline (polyester) resin, the binder resin precursor, and the unmodified resin can be used in combination and also other resins can be contained. The binder resin component preferably contains a polyester resin and more preferably contains it in an amount of 50% by weight or more. When the content of the polyester resin is too small, the low temperature fixing ability tends to deteriorate. It is particularly preferable that any of the binder resin components is a polyester resin.

Specific examples of the binder resins other than the polyester resins include, but are not limited to, styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc.

Toner Manufacturing Method in Aqueous Medium

Suitable aqueous media for use in the present disclosure include water, and a mixture of water and a solvent which is mixable with water. Specific examples of such a solvent include, but are not limited to, alcohols (e.g., methanol, isopropanol, and ethylene glycol), dimethylformamide, tetrahydrofuran, cellosolves (e.g., methyl cellosolve), lower ketones (e.g., acetone and methyl ethyl ketone), etc.

Components that form toner particles such as binder resin precursors, coloring agents, releasing agents, liquid dispersion of crystalline polyester, charge control agents, and unmodified polyester resins can be mixed when a dispersion body is formed in an aqueous medium. However, it is preferable to preliminarily mix these toner materials and thereafter add the mixture to the aqueous medium for dispersion. In addition, the other toner materials are not necessarily mixed when particles are formed in an aqueous medium but can be added after particles are formed in the aqueous medium. For example, after particles containing no coloring agent are formed, a coloring agent is added thereto by a known dying method.

There is no particular limit to the dispersion method. Known methods such as Low speed shearing methods, high speed shearing methods, friction methods, high pressure jet methods, ultrasonic methods, etc., can preferably be used. Among these methods, the high speed shearing method is preferable because a dispersion body having a particle diameter of from 2 μm to 20 μm can be easily prepared. When a high speed shearing disperser is used, although there is no specific limit to the number of rotation, it normally ranges from 1,000 rpm to 3,000 rpm and preferably from 5,000 to 20,000 rpm. Although there is no specific limit to the dispersion time, it is normally from 0.1 minute to 60 minutes in the batch system. The temperature during the dispersion process is normally from 0° C. to 80° C. (under pressure) and preferably from 10° C. to 40° C.

The amount of the aqueous medium based on 100 parts by weight of the toner component is from 100 parts by weight to 1,000 parts by weight. When the amount of the aqueous medium is too small, the dispersion stability of the toner composition deteriorates so that toner particles having a desired particle diameter are not obtained. In contrast, a ratio of the aqueous medium that is too large is not preferred in terms of the economy. A dispersion agent can be optionally used. The particle size distribution is sharp and dispersion is stabilized when a dispersion agent is used.

As a method of reacting a polyester prepolymer with a compound having an active hydrogen group, it is possible to conduct reaction by adding the compound having an active hydrogen group before dispersion of the toner component in the aqueous medium or start reaction from particle interfaces by adding the compound having an active hydrogen group after dispersion of the toner component in the aqueous medium.

In this case, modified polyesters by the polyester prepolymer are preferentially formed on the surface of the manufactured toner. Thus, it is possible to make a gradient of the concentration of the modified polyester in the thickness direction inside the toner particle.

Specific examples of the dispersion agents to emulsify and disperse in an aqueous liquid the oil phase in which the toner component is dispersed include, but are not limited to, anionic surface active agents such as; alkylbenzene sulfonic acid salts, α-olefin sulfonic acid salts, and phosphoric acid esters; cationic surface active agents such as amine salt type surface active agents such as alkyl amine salts, amino alcohol fatty acid derivatives, polyamine fatty acid derivatives, and imidazoline, and quaternary ammonium salt type anionic surface active agents such as alkyl trimethyl ammonium salts, dialkyl dimethyl ammonium salts, alkyl dimethyl benzyl ammonium salts, pyridinium salts, alkyl isoquinolinium salts, and benzetonium chloride; and nonionic surface active agents such as amopholytic surface active agents such as alanine, dodecyldi (amino ethyl)glycine, di(octyl amonoethyl)glycine, and N-alkyl-N,N-dimethyl ammonium betaine.

In addition, an extremely small amount of a surface active agent having a fluoroalkyl group is effective for a good dispersion. Preferred specific examples of the anionic surface active agents having a fluoroalkyl group include, but are not limited to, fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc.

Specific examples of the marketed products of such surfactants having a fluoroalkyl group include, but are not limited to, SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 104, 105, 112, 123A, 123B, 306A, 501, 201, and 204, which are manufactured by Tohchem Products Co., Ltd.; and FUTARGENT F-100 and F150 manufactured by Neos Company limited.

Specific examples of the cationic surface active agents include, but are not limited to, primary, secondary, and tertiary fatty acid amines having a fluoroalkyl group, fatty acid quaternary ammonium salts such as perfluoroalkyl (having 6 to 10 carbon atoms) sulfoneamide propyltrimethyl ammonium salts, benzalkonium salts, benzetonium chloride, pyridinium salts and imidazolinium salts. Specific examples of the marketed products of the cationic surface active agents include, but are not limited to, SURFLON S-121 (manufactured by Asahi Glass Co., Ltd.), FRORARD FC-135 (manufactured by Sumitomo 3M Ltd.), UNIDYNE DS-202 (manufactured by Daikin Industries, Ltd.), MEGAFACE F-150 and F-824 (manufactured by Dainippon Ink and Chemicals, Inc.), ECTOP EF-132 (manufactured by Tohchem Products Co., Ltd.), and FUTARGENT F-300 (manufactured by Neos Company Limited).

An inorganic compound such as tricalcium phosphate, calcium phosphate, titanium oxide, colloidal silica, and hydroxyapatite can also be used as the inorganic compound dispersant poorly-soluble in water.

Liquid droplet dispersion can be stabilized in an aqueous medium by using a polymer protection colloid or organic particulates insoluble in water. Specific examples of such polymeric protection colloids include, but are not limited to, polymers and copolymers prepared using monomers, for example, acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or a heterocyclic ring having a nitrogen atom (e.g., vinyl pyridine, vinyl pyrrolidone, vinyl imidazole and ethylene imine). In addition, polymers, for example, polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds, for example, methyl cellulose, hydroxyethyl cellulose and hydroxypropyl cellulose, can also be used as the polymeric protection colloid.

When compounds, for example, calcium phosphate, which are soluble in an acid or alkali, are used as a dispersion stabilizer, it is possible to dissolve the calcium phosphate by adding an acid, for example, hydrochloric acid, followed by washing of the resultant particles with water, to remove the calcium phosphate from the particulates. In addition, a zymolytic method can be used to remove such compounds by decomposition.

Such a dispersion agent may remain on the surface of toner particles. However, the dispersion agent is preferably washed out to be removed after the reaction in terms of the charging property of the toner particles.

In addition, a solvent in which a polyester modified by reaction of the polyester prepolymer is soluble can be used to decrease the viscosity of the toner component. Usage of such a solvent is preferable in terms of obtaining particles having a sharp particle size distribution. Also, a volatile solvent having a boiling point lower than 100° C. is preferable because the solvent can be easily removed from the liquid dispersion after the particles are formed. Specific examples of such solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These can be used alone or in combination.

Among these, aromatic based solvent such as toluene and xylene and halogenized hydrocarbons such as methylene chloride, 1,2-dichloroethane, chloroform, and carbon tetrachloride are especially preferred. The content of such a solvent is from 0 to 300 parts by weight, preferably from 0 to 100 parts by weight, and more preferably from 25 parts by weight to 70 parts by weight based on 100 parts by weight of the polyester prepolymer. When such a solvent is used, the solvent is removed therefrom but heating under a normal or reduced pressure condition after the elongation reaction and/or a cross-linking reaction.

The reaction time required for the elongation and/or cross-linking reaction is determined depending on the reactivity of the combination of the polyester prepolymer and compound having an active hydrogen group is from 10 minutes to 40 hours and preferably from 30 minutes to 24 hours. The reaction temperature is from 0° C. to 100° C. and preferably from 10° C. to 50° C. Any known catalyst can be used in the elongation reaction and/or cross linking reaction, if desired. Specific examples thereof include, but are not limited to, tertiary amines such as triethyl amine and imidazole.

In order to remove the organic solvent from the thus prepared emulsion dispersion body, a method is suitably used in which the temperature of the emulsion is gradually raised to completely evaporate and remove the organic solvent in the droplets dispersed in the emulsion. Alternatively, a drying method is also usable in which the emulsion is sprayed in a dry atmosphere to completely evaporate and remove the non-water-soluble organic solvent and the remaining aqueous medium in the drops in the emulsion to form toner particulates. The dry atmosphere can be prepared by heating gases, for example, air, nitrogen, carbon dioxide, and combustion gases. The temperature of the heated gases is preferred to be higher than the highest boiling point of all of the solvents in the emulsion dispersion body. The drying treatment in a short period of time with a drying device such as a spray dryer, a belt dryer, a rotary kiln, etc. is sufficient to obtain desired quality.

When the thus prepared toner particles have and maintain a wide particle size distribution after the washing and drying treatment of the particles, the particle size distribution can be adjusted by classification to obtain a desired particle size distribution.

The classification treatment can be performed in a liquid dispersion using a cyclone, a decanter, or a centrifugal to remove fine particles therefrom. Classification of powder of the toner particles can be conducted after drying but it is preferable to classify the toner particle in the liquid in terms of the efficiency. Obtained undesired toner particulates or coarse particles can be returned to the mixing and kneading process for reuse even when the undesirable toner particulates or coarse particles are in a wet condition.

Removing the dispersion agent from the liquid dispersion as much as possible is preferable and is preferably conducted simultaneously with the classification process.

The thus-prepared toner powder particles can be mixed with other fine particles such as release agent particles, charge control agent particles, fluidizing agent particles, and coloring agent particles. Such fine particles can be fixed on the surface of the toner particles by applying a mechanical impact thereto while the particles and toner particles are integrated. Thus, the fine particles can be prevented from being detached from the toner particles.

Specific examples of such mechanical impact application methods include, but are not limited to, methods in which a mixture is mixed by a blade rotating at a high speed and methods in which a mixture is put into a jet air to accelerate and collide the particles against each other or a collision plate. Specific examples of such mechanical impact applicators include, but are not limited to, ONG MILL (manufactured by Hosokawa Micron Co., Ltd.), modified I TYPE MILL (manufactured by Nippon Pneumatic Mfg. Co., Ltd.) in which the pressure of pulverization air is reduced, HYBRIDIZATION SYSTEM (manufactured by Nara Machine Co., Ltd.), KRYPTRON SYSTEM (manufactured by Kawasaki Heavy Industries, Ltd.), automatic mortars, etc.

External Additive

The toner may contain an external additive to help improving the fluidity, the developability, and the charging property. Inorganic particulates are suitably used as an external additive. The inorganic particulate preferably has a primary particle diameter of from 5 nm to 2 μm, and more preferably from 5 nm to 500 nm. In addition, it is preferred that the specific surface area of such inorganic particulates measured by the BET method is from 20 $m^2/g$ to 500 $m^2/g$. The content of such inorganic particulates is preferably from 0.01% by weight to 5% by weight and particularly preferably from 0.01% to 2.0% by weight based on the weight of the toner. Specific examples of such inorganic particulates include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

In addition, polymer particulates, such as polystyrene, methacrylate copolymers, and acrylate copolymers, which are obtained by soap-free emulsification polymerization, suspension polymerization, and dispersion polymerization and polycondensation thermocuring resin particles such as silicone, benzoguanamine, and nylon, and polymerized particles can be also used.

The fluidizers (external additives) specified above can be surface-treated to improve the hydrophobic property and prevent deterioration of the fluidity characteristics and chargeability in a high humidity environment. Preferred specific examples of surface treatment agents include, but are not limited to, silane coupling agents, silyl agents, silane coupling agents having a fluorine alkyl group, organic titanate coupling agents, aluminum-based coupling agents, silicone oil, and modified-silicone oil.

The toner for use in the present invention may include a cleaning improver to remove the toner (development agent) remaining on an image bearing member such as a photoreceptor and an intermediate transfer body. Specific examples of the cleaning improvers include, but are not limited to, metal salts of fatty acid such as zinc stearate and calcium stearate; and polymer particulates such as polymethyl methacrylate particulates and polystyrene particulates, which are prepared by a soap-free emulsion polymerization method or the like. Such polymer particulates preferably have a relatively sharp particle size distribution and a volume average particle size of from 0.01 μm to 1 μm.

The acid value of the toner is a significant indicator with regard to the low temperature fixing ability and hot offset resistance, relates to the carboxyl group at the end of an unmodified polyester resin, and preferably ranges from 0.5 KOHmg/g to 40 KOHmg/g to control the low temperature fixing ability (allowable lowest fixing temperature and hot offset occurring temperature).

When the acid value is too large, the elongation reaction and/or cross-linking reaction of the reactive modified polyester resin tends to be insufficiently conducted, thereby degrading the hot offset resistance. When the acid value is too small, the effect of improving the dispersion stability by the base during manufacturing is not easily obtained or the elongation reaction and/or cross-linking reaction of the reactive modified polyester resin tends to proceed easily, thereby degrading the manufacturing stability.

In the present disclosure, the acid value can be measured according to the measuring method described in JIS K0070-1992.

To be specific, add and dissolve 0.5 g (0.3 g for the portion soluble in ethylacetate) of a sample to 120 ml of toluene by stirring at room temperature (23° C.) for about 10 hours: Add 30 ml of ethanol to the solution to obtain a sample solution: If the sample is not dissolved, use a solvent such as dioxane and tetrahydrofuran: Furthermore, measure the acid value of the sample solution at 23° C. using an automatic potentiometric titrator (DL-53 Titrator, manufactured by Mettler Toledo International Inc.) and an electrode (DG113-SC, manufactured by Mettler Toledo International Inc.) and analyze the result with analysis software (LabX Light Version 1.00. 000).

A solvent mixture of 120 ml of toluene and 30 ml of ethanol is used to calibrate the device.

The measuring conditions are the same as measuring the hydroxyl value.

The acid value is measured as described above. To be specific, titrate a sample with 0.1 N potassium hydroxide/alcohol solution preliminarily titrated and calculate the acid value by the titration amount from the following relationship: Acid value [KOHmg/g]=Amount of titration [ml]×N×56.1 [mg/ml]/mass of sample, where N represents the factor of 0.1 N potassium hydroxide/alcohol solution.

The endotherm peak temperature and the endotherm shoulder temperature of the crystalline polyester, the non-crystalline polyester, and the toner are measured by, for example, a DSC (Differential Scanning calorimeter) system (DSC-60, manufactured by Shimadzu Corporation).

To be specific, the endotherm shoulder 1, the endotherm peak, the endotherm shoulder 2 of a sample are measured by the following process:

Place about 5.0 mg of a polyester resin in an sample container, put on the sample container on a holder unit, and set it in an electrical furnace; Heat the sample container in nitrogen atmosphere from 0° C. to 150° C. at a temperature rising speed of 10° C./min.; Cool down the system from 150° C. to 0° C. at a temperature falling speed of 10° C./min and heat the system to 150° C. at a temperature rising speed of 10° C./min; Measure the system by a differential scanning calorimeter (DSC-60, manufactured by Shimadzu Corporation).

From the obtained DSC curve, using the analysis program in the DSC-60 system, select the DSC curve at the first temperature rising, draw a base line based on the stable state in the low temperature range and the high temperature range, and measure the endotherm amount in the area conversion in the range of from 50° C. to 100° C.

In addition, the particle size distribution is measured by a Coulter Counter method.

Coulter Counter TA-II and Coulter Multisizer II (both are manufactured by Beckman Coulter, Inc.), etc. can be used as the measuring equipment for Coulter Counter method.

In the present disclosure, the particle distribution is measured by Coulter Counter TAII that is connected with PC 9801 home computer (manufactured by NEC Corporation) via an interface (manufactured by The Institute of Japanese Union of Scientists & Engineers) that outputs the number distribution and the volume distribution.

To be specific, add 0.1 ml to 5 ml of a surface active agent (preferably alkyl benzene sulfonate salt) as a dispersant to 100 ml to 150 ml of an electrolytic aqueous solution, which is about 1% NaCl aqueous solution prepared by using primary NaCl and pure water, for example, ISOTON-II (manufactured by Beckman Coulter, Inc.) can be used. Then, add 2 mg to 20 mg of a sample to obtain a liquid suspension and disperse it for one minute to three minutes by an ultrasonic disperser. Measure the volume and the number of the toner with a 100 μm aperture from the obtained liquid dispersion and calculate the volume distribution and the number distribution.

The whole range including 13 channels is a particle diameter of from 2.00 μm to not greater than 40.30 μm. Each channel is: from 2.00 to not greater than 2.52 μm; from 2.52 μm to not greater than 3.17 μm; from 3.17 μm to not greater than 4.00 μm; from 4.00 μm to not greater than 5.04 μm; from 5.04 μm to not greater than 6.35 μm; from 6.35 μm to not greater than 8.00 μm; from 8.00 μm to not greater than 10.08 μm; from 10.08 μm to not greater than 12.70 μm; from 12.70 μm to not greater than 16.00 μm, from 16.00 μm to not greater than 20.20 μm; from 20.20 μm to not greater than 25.40 μm; from 25.40 μm to not greater than 32.00 μm; and from 32.00 μm to not greater than 40.30 μm.

The toner preferably has a volume average particle diameter of from 3 μm to 7 μm and the ratio of the volume average particle diameter to the number average particle diameter is 1.2 or less. In addition, it is preferable to contain a component having a particle diameter of 2 μm or less in an amount of from 1% by number to 10% by number.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Crystalline Polyester

Synthesis of Crystalline Polyester Resin 1

Place 2,300 g of 1,10-decanedioic acid, 2,530 g of 1,8-octane diol, and 4.9 g of hydroquinone in a flask equipped with a nitrogen gas introducing tube, a dewatering conduit, a stirrer, and a thermocouple, conduct reaction at 180° C. for eight hours, heat the system to 215° C. followed by a three-hour reaction, and continue reaction under 8.3 kPa for two hours to obtain [Crystalline Polyester Resin 1]. The thermo-characteristics (endotherm peak) of DSC and the molecular weight measured by GPC are shown in Table 1.

Synthesis of Crystalline Polyester Resin 2

Place 2,300 g of 1,10-decanedioic acid, 2,530 g of 1,8-octane diol, and 4.9 g of hydroquinone in a flask equipped with a nitrogen gas introducing tube, a dewatering conduit, a stirrer, and a thermocouple, conduct reaction at 170° C. for seven hours, heat the system to 205° C. followed by a two-hour reaction, and continue reaction under 7.8 kPa for one hour to obtain [Crystalline Polyester Resin 2]. The thermocharacteristics (endotherm peak) of DSC and the molecular weight measured by gel permeation chromatography (GPC) are shown in Table 1.

Synthesis of Crystalline Polyester Resin 3

Place 2,300 g of 1,10-decanedioic acid, 2,530 g of 1,8-octane diol, and 4.9 g of hydroquinone in a flask equipped with a nitrogen gas introducing tube, a dewatering conduit, a stirrer, and a thermocouple, conduct reaction at 180° C. for eight hours, heat the system to 210° C. followed by a three-hour reaction, and continue reaction under 8.3 kPa for two hours to obtain [Crystalline Polyester Resin 3]. The thermo-characteristics (endotherm peak) of DSC and the molecular weight measured by GPC are shown in Table 1.

Synthesis of Crystalline Polyester Resin 4

Place 2,160 g of fumaric acid, 2,320 g of 1,6-hexane diol, and 4.9 g of hydroquinone in a flask equipped with a nitrogen gas introducing tube, a dewatering conduit, a stirrer, and a thermocouple, conduct reaction at 185° C. for eight hours, heat the system to 205° C. followed by a three-hour reaction, and continue reaction under 8.3 kPa for two hours to obtain [Crystalline Polyester Resin 4]. The thermocharacteristics (endotherm peak) of DSC and the molecular weight measured by GPC are shown in Table 1.

TABLE 1

| | Endotherm peak temperature (° C.) of crystalline polyester | Mw | Mn | MW/Mn |
|---|---|---|---|---|
| Crystalline polyester 1 | 70 | 11,300 | 3,200 | 3.5 |
| Crystalline polyester 2 | 63 | 8,500 | 2,600 | 3.3 |
| Crystalline polyester 3 | 79 | 12,500 | 3,500 | 3.6 |
| Crystalline polyester 4 | 58 | 12,800 | 2,300 | 5.6 |

Releasing Agent

Releasing Agent 1

HNP-9 (manufactured by Nippon Seiro Company Limited) is used.

Non-crystalline Polyester

Synthesis of Non-crystalline Polyester (Low Molecular Weight Polyester) 1

Place 229 parts of an adduct of bisphenol A with 2 mole of ethylene oxide, 529 parts of an adduct of bisphenol A with 3 mole of propylene oxide, 100 parts of isophthalic acid, 108 parts of terephthalic acid, 46 parts of adipic acid, and 2 parts of dibutyltin oxide in a flask equipped with a nitrogen gas introducing tube, a dewatering conduit, a stirrer, and a thermocouple, conduct reaction at 230° C. for ten hours, continue reaction under reduced pressure of 10 mmHg to 15 mmHg for five hours, and place 30 parts of anhydride of trimellitic acid in the flask followed by reaction at 180° C. at normal pressure for three hours to obtain [Non-crystalline Polyester 1]. [Non-crystalline Polyester 1] has a number average molecular weight of 1,800, a weight average molecular weight of 5,500, a glass transition temperature Tg of 50° C., and an acid value of 20.

Synthesis of Non-Crystalline Polyester (Low Molecular Weight Polyester) 2

Place 229 parts of an adduct of bisphenol A with 2 mole of ethylene oxide, 529 parts of an adduct of bisphenol A with 3 mole of propylene oxide, 100 parts of isophthalic acid, 108 parts of terephthalic acid, 46 parts of adipic acid, and 2 parts of dibutyltin oxide in a flask equipped with a nitrogen gas introducing tube, a dewatering conduit, a stirrer, and a thermocouple, conduct reaction at 220° C. for eight hours, continue reaction under a reduced pressure of 10 mmHg to 15 mmHg for five hours, and place 30 parts of anhydride of trimellitic acid in the flask followed by reaction at 180° C. at normal pressure for three hours to obtain [Non-crystalline Polyester 2]. [Non-crystalline Polyester 2] has a number average molecular weight of 1,600, a weight average molecular weight of 4,800, a glass transition temperature Tg of 55° C., and an acid value of 17.

Synthesis of Polyester Prepolymer

Place the following recipe in a container equipped with a condenser, a stirrer, and a nitrogen introducing tube to conduct a reaction at 230° C. at normal pressure for eight hours followed by another reaction for five hours with a reduced pressure of 10 to 15 mmHg to synthesize [Intermediate Polyester Resin 1]:

Adduct of bisphenol A with 2 mole of ethylene oxide: 682 parts

Adduct of bisphenol A with 2 mole of propylene oxide: 81 parts

Terephthalic acid: 283 parts

Trimellitic anhydride: 22 parts

Dibutyl tin oxide: 2 parts

The obtained [Intermediate Polyester Resin 1] has a number average molecular weight of 2,100, a weight average molecular weight of 9,500, a glass transition temperature of 55° C., an acid value of 0.5, and a hydroxyl value of 51.

Next, place 410 parts of [Intermediate Polyester 1], 89 parts of isophorone diisocyanate, and 500 parts of ethyl acetate in a reaction container equipped with a condenser, stirrer, and a nitrogen introducing tube to conduct reaction at 100° C. for five hours to obtain [Prepolymer 1]. The weight % of isolated isocyanate of the obtained [Prepolymer 1] is 1.53%.

Synthesis of Ketimine

Place 170 parts of isophoronediamine and 75 parts of methylethyl ketone in a reaction container equipped with a stirrer and a thermometer to conduct reaction at 50° C. for five hours to obtain [Ketimine Compound 1].

The obtained [Ketimine Compound 1] has an amine value of 418.

Synthesis of Master Batch

BK (Black)

Admix 1,200 parts of water, 540 parts of carbon black (Printex 35, manufactured Degussa AG, DBP oil absorption amount: 42 ml/100 mg, PH: 9.5), and 1,200 parts of a polyester resin in a Henschel Mixer (manufactured by NIPPON COKE & ENGINEERING CO., LTD.), mix and knead the mixture at 150° C. for 30 minutes using two rolls; and roll and cool down the resultant followed by pulverization by a pulverizer to obtain [Master Batch BK].

M (Magenta):

Obtain [Master Batch M] in the same manner as in BK except that Pigment Red: 269 (manufactured by DIC Corporation) is used instead of carbon black.

C (Cyan):

Obtain [Master Batch C] in the same manner as in BK except that Pigment Blue: 15-3 is used instead of carbon black.

Y (yellow):

Obtain [Master Batch Y] in the same manner as in BK except that Pigment Yellow: 74 is used instead of carbon black.

Preparation of Oil Phase

Place 378 parts of [Non-crystalline Polyester 1], 110 parts of [Releasing Agent 1], 22 parts of a charge control agent (CCA) (metal complex of salicylic acid: E-84, manufactured by Orient Chemical Industries Co., Ltd.), and 947 parts of ethyl acetate in a reaction container equipped with a stirrer and a thermometer. Heat the system to 80° C. while stirring, maintain the system at 80° C. for five hours, and then cool it down to 30° C. in one hour. Next, place 500 parts of [Master batch BK] and 500 parts of ethyl acetate in the reaction container followed by mixing for one hour to obtain [Raw Material Solution 1].

Move 1,324 parts of [Raw Material Solution 1] to a container to disperse carbon black and wax using a bead mill (ULTRAVISCOMILL from AIMEX) under the following conditions: Liquid feeding speed: 1 kg/hour; Disc perimeter speed: 6 m/sec; Diameter of zirconia beads: 0.5 mm; Filling factor of zirconia beads: 80% by volume; Repeat number of dispersion treatment: three passes. Next, add 1042.3 parts of 65% ethyl acetate solution of [Non-crystalline Polyester 1] and conduct dispersion with one pass under the conditions specified above with a bead mill to obtain [Pigment/Wax Liquid Dispersion 1]. The concentration of the solid portion of the obtained. [Pigment/Wax Liquid Dispersion 1] is 50% at 130° C. for 30 minutes.

Preparation of Liquid Dispersion of Crystalline Polyester

Place 100 g of [Crystalline Polyester Resin 1] and 400 g of ethyl acetate in a metal container and heat the system to dissolve the resin at 75° C. followed by rapid cooling down in an ice water bath at a temperature falling speed of 27° C./min. Add 500 ml of glass beads (3 mm ϕ) to the system and pulverize the system by a batch type sand mill (manufactured by Kanpe Hapio Co., Ltd.) for 10 hours to obtain [Liquid Dispersion 1 of Crystalline Polyester].

In addition, obtain [Liquid Dispersion 2 of Crystalline Polyester] in the same manner as in preparation of [Liquid Dispersion 1 of Crystalline Polyester] except that [Crystalline Polyester Resin 1] is replaced with [Crystalline Polyester Resin 2].

In addition, obtain [Liquid Dispersion 3 of Crystalline Polyester] in the same manner as in preparation of [Liquid Dispersion 1 of Crystalline Polyester] except that [Crystalline Polyester Resin 1] is replaced with [Crystalline Polyester Resin 3].

In addition, obtain [Liquid Dispersion 4 of Crystalline Polyester] in the same manner as in preparation of [Liquid Dispersion 1 of Crystalline Polyester] except that [Crystalline Polyester Resin 1] is replaced with [Crystalline Polyester Resin 4].

Synthesis of Organic Particulate Emulsion

Place the following recipe in a container equipped with a stirrer and a thermometer and stir the recipe at 400 rpm for 15 minutes to obtain a white emulsion: Water: 683 parts;

Sodium salt of sulfuric acid ester of an adduct of methacrylic acid with ethylene oxide (EREMINOR RS-30, manufactured by Sanyo Chemical Industries, Ltd.): 11 parts; Styrene: 138 parts;

Methacrylic acid: 138 parts;

Ammonium persulfate: 1 part Heat the system to 75° C. to continue the reaction for five hours. Add 30 parts of aqueous solution of 1% ammonium persulfate thereto and age the resultant at 75° C. for five hours to obtain an aqueous liquid dispersion [Liquid Dispersion 1 of Particulate] of a vinyl resin (copolymer of styrene—methacrylic acid—sodium salt of an adduct of sulfuric acid ester with ethylene oxide methacrylate). The volume average particle diameter of [Liquid Dispersion 1 of Particulate] is 0.14 μm when measured by LA-920. Isolate the resin portion by drying a portion of [Liquid Dispersion 1 of Particulate].

Preparation of Aqueous Phase

Mix and stir 990 parts of water, 83 parts of [Liquid Dispersion 1 of Particulate], 37 parts of 48.5 weight % aqueous solution of sodium disulfonate of dodecyldiphenyl ether (EREMINOR MON-7, manufactured by Sanyo Chemical Industries, Ltd.), and 90 parts of ethyl acetate to obtain milk white liquid. This is determined as [Aqueous Phase 1].

Emulsification/Solvent Removal

Place 664 parts of [Liquid Dispersion 1 of Particulate], 109.4 parts of [Prepolymer 1], 73.9 parts of [Liquid Dispersion 1 of Crystalline Polyester], and 4.6 parts of [Ketimine Compound 1] in a container and mix them by a TK HOMOMIXER (manufactured by Tokushu Kika Kogyo Co., Ltd.) at 5,000 rpm for one minute. Thereafter, add 1,200 parts of [Aqueous Phase 1] to the container and mix the system by the TK HOMOMIXER at 13,000 rpm for 20 minutes to obtain [Emulsified Slurry 1].

Place [Emulsified Slurry 1] in a container equipped with a stirrer and a thermometer and remove the solvent at 30° C. for eight hours followed by aging at 45° C. for four hours to obtain [Slurry Dispersion 1].

Washing and Drying

After 100 parts of [Slurry dispersion 1] is filtered with a reduced pressure;

(1): Add 100 parts of deionized water to the filtered cake and mix the resultant by a TK HOMOMIXER at 12,000 rpm for 10 minutes;

(2): Add 100 parts of 10% sodium hydroxide to the filtered cake obtained in (1) and mix the resultant by a TK HOMOMIXER at 12,000 rpm for 30 minutes followed by filtration with a reduced pressure;

(3): Add 100 parts of 10% hydrochloric acid to the filtered cake obtained in (2) and mix the resultant by a TK HOMOMIXER at 12,000 rpm for 10 minutes followed by filtration.

(4): Add 300 parts of deionized water to the filtered cake obtained in (3) and mix the resultant by a TK HOMOMIXER at 12,000 rpm for 10 minutes followed by filtration.

(5): Repeat (4) once again to obtain [Filtered Cake 1].

Dry [Filtered Cake 1] by a circulating drier at 45° C. for 48 hours and sieve the dried cake using a screen having an opening of 75 μm.

Externally add 0.5 parts of a hydrophobic silica having a primary particle diameter of 15 nm, 1.0 part of a hydrophobic silica having an average particle diameter of 120 nm, and 0.5 parts of hydrophobic titanium oxide to 100 parts of the thus-obtained mother toner particles and mix them by a HENSCHEL MIXER (manufactured by NIPPON COKE & ENGINEERING CO., LTD.) to manufacture [Toner 1-BK].

With regard to yellow toner, [Toner 1-Y] is manufactured in the same manner as in manufacturing of [Toner 1-BK] except that [Master Batch BK] is replaced with [Master Batch Y] in the oil phase preparation process for black toner and the amount of [Liquid Dispersion 1 of Crystalline Polyester] for use in emulsification is changed to 96 parts.

With regard to cyan toner, [Toner 1-C] is manufactured in the same manner as in manufacturing of [Toner 1-BK] except that [Master Batch BK] is replaced with [Master Batch C] in the oil phase preparation process for black toner and the amount of [Liquid Dispersion 1 of Crystalline Polyester] for use in emulsification is changed to 96 parts.

With regard to magenta toner, [Toner 1-M] is manufactured in the same manner as in manufacturing of [Toner 1-BK] except that [Master Batch BK] is replaced with [Master Batch M] in the oil phase preparation process for black toner and the amount of [Liquid Dispersion 1 of Crystalline Polyester] for use in emulsification is changed to 96 parts.

Examples 2 to 8 and Comparative Examples 1 to 4

Toners of Examples 2 to 8 and Comparative Examples 1 to 4 are manufactured in the same manner as in Example 1 except that the kinds and the amounts of the non-crystalline polyesters and liquid dispersions of crystalline polyesters are changed. The addition amount of the wax is the same.

Example 9

Toner of Example 9 is manufactured in the same manner as in Example 1 except that the addition amount of the wax is changed to 4/5 only for the black toner.

Example 10

Unmodified polyester resin 2: 75 parts
Crystalline polyester 3: 8 parts
Master batch BK: 8 parts With regard to yellow toner, [Toner 10-Y] is manufactured in the same manner as in manufacturing of [Toner 10-BK] except that [Master Batch BK] is replaced with [Master Batch Y] in the oil phase preparation process for black toner.

With regard to cyan toner, [Toner 10-C] is manufactured in the same manner as in manufacturing of [Toner 10-BK] except that [Master Batch BK] is replaced with [Master Batch C] in the oil phase preparation process for black toner.

With regard to magenta toner, [Toner 10-M] is manufactured in the same manner as in manufacturing of [Toner 10-BK] except that [Master Batch BK] is replaced with [Master Batch M] in the oil phase preparation process for black toner.

In addition, the same toner is used in Examples and Comparative Examples in some cases.

To be specific, the full color (Fc) toner of Example 1 is used in Example 5 and Comparative Examples 1 and 4 and Bk toner of Example 1 is used in Example 6 and Comparative Example 3. In addition, the full color (Fc) toner of Example 3 is identical to that of Example 6.

TABLE 2

| | | Bk | | Fc | | |
|---|---|---|---|---|---|---|
| | Non-crystalline polyester resin | Crystalline polyester kind | Amount of heat (mJ/mg) | Crystalline polyester kind | Amount of heat (mJ/mg) | EBk/EFc |
| Example 1 | 2 | 1 | −145 | 1 | −160 | 0.91 |
| Example 2 | 1 | 1 | −140 | 1 | −155 | 0.90 |
| Example 3 | 2 | 2 | −150 | 2 | −165 | 0.91 |
| Example 4 | 2 | 3 | −135 | 3 | −150 | 0.90 |
| Example 5 | 2 | 1 | −138 | 1 | −160 | 0.86 |
| Example 6 | 2 | 1 | −145 | 2 | −165 | 0.88 |
| Example 7 | 2 | 4 | −120 | 4 | −135 | 0.89 |
| Example 8 | 2 | 1 | −85 | 1 | −96 | 0.89 |
| Example 9 | 2 | 1 | −138 | 1 | −160 | 0.86 |
| Example 10 | 2 | 1 | −145 | 1 | −160 | 0.91 |
| Comparative Example 1 | 2 | 1 | −160 | 1 | −160 | 1.00 |
| Comparative Example 2 | 1 | 1 | −140 | 2 | −140 | 1.00 |
| Comparative Example 3 | 2 | 1 | −145 | 2 | −100 | 1.45 |
| Comparative Example 4 | 2 | 1 | −85 | 1 | −160 | 0.53 |

Charge control agent: E-84 (manufactured by Orient Chemical Industries Co., Ltd.): 3 parts Releasing agent 1: 5 parts Mix the recipe specified above by a HENSCHEL MIXER, mix and knead the mixture by a Kneadex (mixing and kneading machine) while the surface temperature is set at 50° C., roll and cooling down, pulverize the mixture, and air-classify the resultant by a jet mill type pulverizer (1-2 type mill, manufactured by Nippon Pheumatic Mfg. Co.) and an air-classifier (DS classifier, manufactured by Nippon Pheumatic Mfg. Co.) using a swirl flow to obtain a black colored particles having a weight average particle diameter of 5.8 μm and a number average particle diameter of 4.8 μm.

Externally add 0.5 parts of a hydrophobic silica having a primary particle diameter of 15 nm, 1.0 part of a hydrophobic silica having an average particle diameter of 120 nm, 0.5 parts of hydrophobic titanium oxide to 100 parts of the thus-obtained mother toner particles and mix them by a HENSCHEL MIXER (manufactured by NIPPON COKE & ENGINEERING CO., LTD.) to manufacture toner [Toner 10-BK].

High Temperature Preservation Property

Preserve the toner at 50° C. for eight hours and thereafter screen the toner with a sieve having a 42 mesh for two minutes. Measure the remaining ratio of the toner on the wire screen.

Toner having a good high temperature preservation property has a small remaining ratio.

The evaluation criteria with regard to the high temperature preservation property are as follows:

E (Excellent): remaining ratio is less than 10%

G (Good): remaining ratio is from 10% to less than 20%

F (Fair): remaining ratio is from 20% to less than 30%

P (Poor): remaining ratio is 30% or higher

Allowable Lowest Fixing Limit

Use a band image (attached amount of toner: 0.85 mg/cm2) as a sample image and continuously print 30,000 images under the condition of 25° C. and 70% RH. The paper used is Type 6000 (70 W, manufactured by Ricoh Co., Ltd.)

Confirm that the obtained sample image is not peeled off and the image is evaluated according to the following criteria about the image concentration remaining ratio after rubbing the image with a fixing pad:

G (Good): 85% or higher

F (Fair): high than 70% to less than 85%

P (Poor): the image is peeled off or the image concentration remaining ratio is 70% or less Hot Offset Check the obtained sample image and evaluate the image by confirming whether the image transfer occurs after fixing.

G (Good): No

B (Bad): Yes

Gloss

Check the gloss of the obtained sample image by VSG-1 (manufactured by Nippon Denshoku Industries Co., Ltd.)

The gloss of the color is the average of the three colors of yellow, magenta, and cyan.

The gloss of the black toner is evaluated by the ratio of the gloss of the black toner to that of the full color toner according to the following criteria.

G (Good): 50% to 90%

B (Bad): Other than the above

TABLE 3

| | Gloss | | | Allowable lowest fixing | Preserv- | Allowable highest fixing | |
|---|---|---|---|---|---|---|---|
| | Bk | Fc | Gloss ratio | temperature | ability | temperature | Evaluation |
| Example 1 | 16 | 22 | 0.73 | G | G | G | Excellent |
| Example 2 | 18 | 22 | 0.82 | G | G | G | Excellent |
| Example 3 | 13 | 18 | 0.72 | G | G | G | Excellent |
| Example 4 | 16 | 20 | 0.80 | G | G | G | Excellent |
| Example 5 | 11 | 22 | 0.50 | G | G | G | Excellent |
| Example 6 | 16 | 18 | 0.89 | G | G | G | Excellent |
| Example 7 | 15 | 19 | 0.79 | G | F | G | Good |
| Example 8 | 23 | 30 | 0.77 | F | F | G | Fair |
| Example 9 | 20 | 22 | 0.91 | G | G | G | Good |
| Example 10 | 15 | 20 | 0.75 | G | F | F | Fair |
| Comparative Example 1 | 22 | 22 | 1.00 | G | G | G | Bad |
| Comparative Example 2 | 22 | 22 | 1.00 | G | G | G | Bad |
| Comparative Example 3 | 16 | 10 | 1.60 | G | G | B | Bad |
| Comparative Example 4 | 6 | 22 | 0.27 | G | G | G | Bad |

What is claimed is:

1. A set of toners including yellow, cyan, magenta, and black toner, each of which comprises:

a binder resin comprising a crystalline resin and a non-crystalline resin;

a releasing agent; and a corresponding coloring agent, wherein the following relationship is satisfied:

$$0.8<EBk/EFc<0.95$$

where EBk represents an amount of heat of melting (mJ/mg) for the black toner and EFc represents an average amount of heat of melting (mJ/mg) of the yellow toner, magenta toner, and cyan toner from 50° C. to 100° C. at a first temperature rising in differential scanning calorimetry (DSC).

2. The set of toners according to claim 1, wherein the crystalline resin and the non-crystalline resins are both polyester resins.

3. The set of toners according to claim 2, wherein the crystalline polyester resin in the black toner is different from the crystalline polyester resin in the yellow toner, the cyan toner, and the magenta toner.

4. The set of toners according to claim 2, wherein a content of the crystalline polyester resin in the black toner is different from a content of the crystalline polyester resin in the yellow toner, the cyan toner, and the magenta toner.

5. The set of toners according to claim 1, wherein the crystalline resin has a melting point of from 55° C. to 80° C.

6. The set of toners according to claim 1, wherein the releasing agent has a melting point of from 60° C. to 80° C.

7. The set of toners according to claim 1, wherein, each toner comprises a soluble portion of the crystalline resin in o-dichlorobenzene that has a weight average molecular weight (Mw) of from 3,000 to 30,000, a number average molecular weight (Mn) of from 1,000 to 10,000, and a molecular weight distribution (Mw/Mn) of from 1 to 10 as measured by gel permeation chromatography (GPC).

8. The set of toners according to claim 1, wherein, each toner comprises a soluble portion of the crystalline resin in o-dichlorobenzene that has a weight average molecular weight (Mw) of from 5,000 to 15,000, a number average molecular weight (Mn) of from 2,000 to 10,000, and a molecular weight distribution (Mw/Mn) of from 1 to 5.

9. The set of toners according to claim 1, wherein each toner is manufactured by granulating in an aqueous medium.

10. The set of toners according to claim 9, wherein each toner is obtained by dissolving and/or dispersing the corresponding coloring agent, the releasing agent, the crystalline resin, and the non-crystalline resin in an organic solvent to obtain an oil phase, dispersing the oil phase in an aqueous medium to obtain an emulsified liquid dispersion, and removing the organic solvent therefrom.

11. A set of development agents comprising:

a carrier; and the set of toners of claim 1.

12. The set of toners according to claim 1, wherein a content of the releasing agent contained in the black toner is different from the content of the releasing agent contained in the yellow toner, the cyan toner, and the magenta toner.

* * * * *